US008549877B2

(12) United States Patent
Santos

(10) Patent No.: US 8,549,877 B2
(45) Date of Patent: Oct. 8, 2013

(54) APPARATUS AND METHODS FOR DECOMPRESSING AND DISCHARGING NATURAL GAS UTILIZING A COMPRESSOR OR A TEMPERATURE-ACTUATED VALVE

(75) Inventor: Pedro T Santos, Cambridge, MA (US)

(73) Assignee: OsComp Systems Inc., Houston, TX (US)

( * ) Notice: Subject to any disclaimer, the term of this patent is extended or adjusted under 35 U.S.C. 154(b) by 0 days.

(21) Appl. No.: 13/552,606

(22) Filed: Jul. 18, 2012

(65) Prior Publication Data

US 2012/0279235 A1 Nov. 8, 2012

Related U.S. Application Data

(63) Continuation of application No. 13/364,824, filed on Feb. 2, 2012.

(60) Provisional application No. 61/462,459, filed on Feb. 2, 2011.

(51) Int. Cl.
*F25J 1/00* (2006.01)
*F25J 3/00* (2006.01)

(52) U.S. Cl.
USPC ..... 62/618; 62/611; 62/619

(58) Field of Classification Search
USPC ..... 62/617, 618, 619, 50.2
See application file for complete search history.

(56) References Cited

U.S. PATENT DOCUMENTS

| | | | | |
|---|---|---|---|---|
| 4,220,009 | A * | 9/1980 | Wenzel | 60/648 |
| 5,003,782 | A | 4/1991 | Kucerija | |
| 5,291,738 | A * | 3/1994 | Waldrop | 62/617 |
| 5,325,894 | A * | 7/1994 | Kooy et al. | 141/4 |
| 5,685,154 | A | 11/1997 | Bronicki et al. | |
| 5,873,263 | A * | 2/1999 | Chang | 62/617 |
| 6,125,873 | A | 10/2000 | Brown | |
| 6,155,051 | A | 12/2000 | Williams | |
| 6,626,202 | B1 | 9/2003 | Harvey | |
| 6,722,386 | B2 | 4/2004 | Harvey | |
| 6,886,362 | B2 | 5/2005 | Wilding et al. | |
| 6,918,402 | B2 | 7/2005 | Harvey | |
| 7,757,503 | B2 | 7/2010 | Taylor | |
| 2011/0094264 | A1 * | 4/2011 | Geers et al. | 62/618 |

* cited by examiner

*Primary Examiner* — Mohammad M Ali
*Assistant Examiner* — Daniel C Comings
(74) *Attorney, Agent, or Firm* — American Patent Agency PC; Daniar Hussain; Brian Smith

(57) ABSTRACT

One embodiment of the present invention is a portable natural gas discharge system for discharging compressed natural gas into a receiving location. The system comprises a portable chassis for holding the natural gas discharge system and all subcomponents, an inlet port for receiving the natural gas at an inlet pressure higher than a pressure of the receiving location, an expansion valve for regulating pressure of the natural gas to a stable intermediate pressure, a heat exchanger for heating up the cooled natural gas stream as a result of cooling due to expansion, a regulator for regulating a flow of the heated natural gas stream through the heat exchanger and out of the portable natural gas discharge system, and a discharge port for discharging the heated natural gas stream into the receiving location.

12 Claims, 17 Drawing Sheets

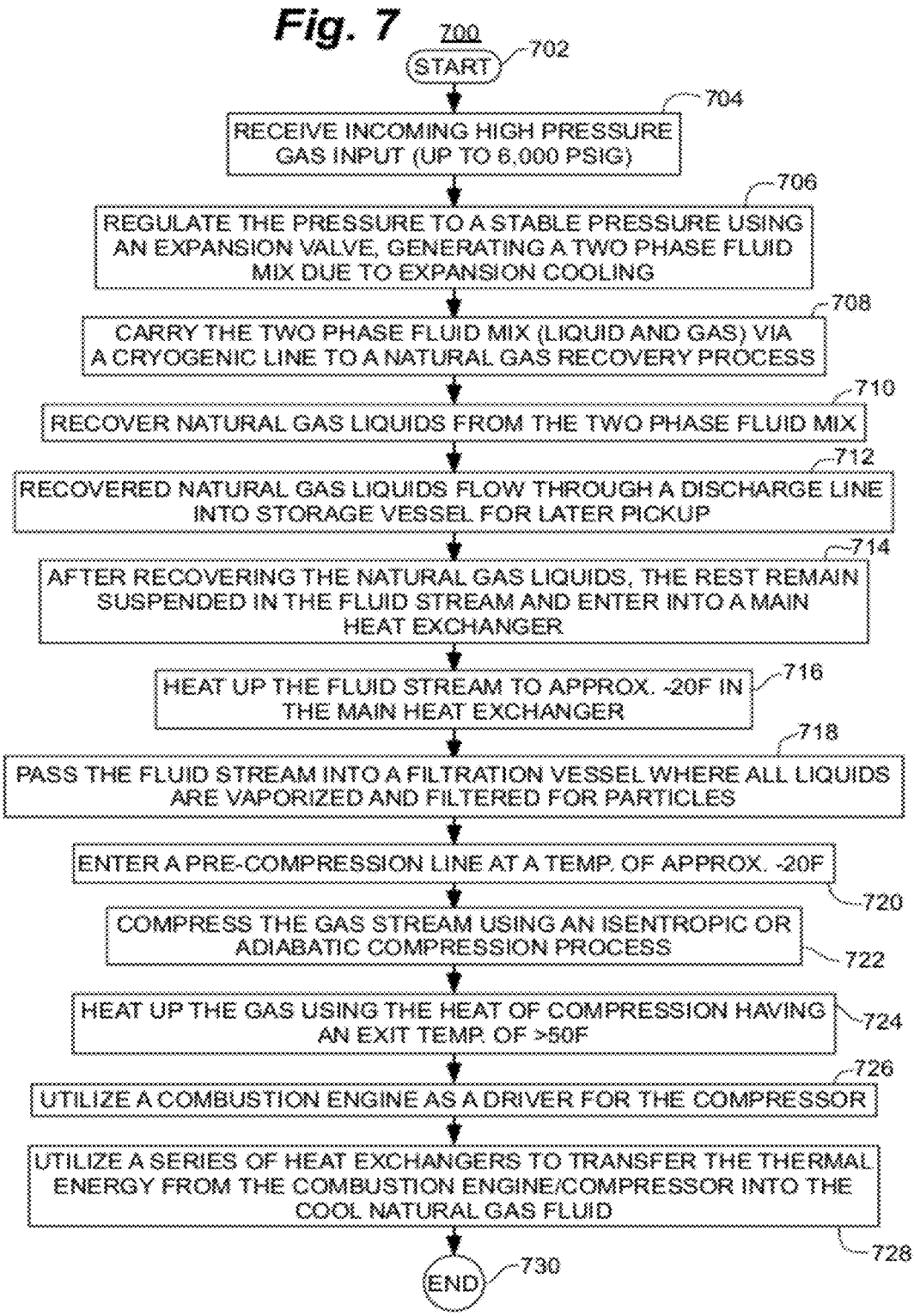
Fig. 7
700
START
702
RECEIVE INCOMING HIGH PRESSURE GAS INPUT (UP TO 6,000 PSIG)
704
REGULATE THE PRESSURE TO A STABLE PRESSURE USING AN EXPANSION VALVE, GENERATING A TWO PHASE FLUID MIX DUE TO EXPANSION COOLING
706
CARRY THE TWO PHASE FLUID MIX (LIQUID AND GAS) VIA A CRYOGENIC LINE TO A NATURAL GAS RECOVERY PROCESS
708
RECOVER NATURAL GAS LIQUIDS FROM THE TWO PHASE FLUID MIX
710
RECOVERED NATURAL GAS LIQUIDS FLOW THROUGH A DISCHARGE LINE INTO STORAGE VESSEL FOR LATER PICKUP
712
AFTER RECOVERING THE NATURAL GAS LIQUIDS, THE REST REMAIN SUSPENDED IN THE FLUID STREAM AND ENTER INTO A MAIN HEAT EXCHANGER
714
HEAT UP THE FLUID STREAM TO APPROX. -20F IN THE MAIN HEAT EXCHANGER
716
PASS THE FLUID STREAM INTO A FILTRATION VESSEL WHERE ALL LIQUIDS ARE VAPORIZED AND FILTERED FOR PARTICLES
718
ENTER A PRE-COMPRESSION LINE AT A TEMP. OF APPROX. -20F
720
COMPRESS THE GAS STREAM USING AN ISENTROPIC OR ADIABATIC COMPRESSION PROCESS
722
HEAT UP THE GAS USING THE HEAT OF COMPRESSION HAVING AN EXIT TEMP. OF >50F
724
UTILIZE A COMBUSTION ENGINE AS A DRIVER FOR THE COMPRESSOR
726
UTILIZE A SERIES OF HEAT EXCHANGERS TO TRANSFER THE THERMAL ENERGY FROM THE COMBUSTION ENGINE/COMPRESSOR INTO THE COOL NATURAL GAS FLUID
728
END
730

APPARATUS AND METHODS FOR DECOMPRESSING AND DISCHARGING NATURAL GAS UTILIZING A COMPRESSOR OR A TEMPERATURE-ACTUATED VALVE

REFERENCE TO RELATED APPLICATIONS

This application is a continuation of and claims priority from U.S. Ser. No. 13/364,824, filed on Feb. 2, 2012 and entitled "APPARATUS AND METHODS FOR REGULATING MATERIAL FLOW USING A TEMPERATURE-ACTUATED VALVE," which itself is a non-provisional of and claims priority from provisional application U.S. Ser. No. 61/462,459, filed on Feb. 2, 2011, and entitled "High-Efficiency Compression-based Heater Discharge/Expansion Station," the entirety of which is hereby incorporated by reference herein. This application is related to PCT Serial No. PCT/US2012/23641, which also claims priority from provisional application U.S. Ser. No. 61/462,459, filed on Feb. 2, 2011.

FIELD OF THE INVENTION

The present invention is generally related to mechanical devices and fluid systems. One embodiment of the present invention is an apparatus and method for decompressing and discharging natural gas utilizing a compressor. Another embodiment is an apparatus and method for decompressing and discharging natural gas utilizing a temperature-actuated valve.

BACKGROUND OF THE INVENTION

The statements in this section merely provide background information related to the present disclosure and may not constitute prior art.

Adiabatic compression is known as the process through which gases are reduced in volume and as a byproduct, a large amount of energy is converted into heat. Most commonly, this heat is removed by a cooling fluid through heat exchangers. Immediately or eventually, most of this heat is disposed of into the environment. This heat is generally referred to as heat of compression.

Gas expansion has the opposite effect—the gas cools as it expands and most of the heat is absorbed directly or indirectly from the surrounding environment. Most gas pipelines also suffer from cooling as the gas expands and looses pressure through a pipeline, before coming to a booster station or gate station, where gas is expanded even further to reduce it to local transmission line pressures. Compressor-booster stations reside along gas pipelines to increase pressure marginally and many times, due to their minimal temperature rise during compression, they are operated without an aftercooler, leaving most of the heat of compression in the pipeline. Expander stations typically use electrical or gas-fired heaters to increase the temperature to practical levels, for example, to avoid hydrate formation.

Most compressors are driven using internal combustion engines, and these so-called drivers tend to have low energy conversion efficiencies, in the order of 25%-50%, with the rest of the energy converted to waste heat, which is disposed of into the surrounding environment.

In short, when a gas or vapor at high pressure expands through a valve into a reservoir at lower pressure, the pressure drop is accompanied by a cooling of the gas called the Joule-Thompson effect. If the gas cools too much, it can freeze in the gas line, plugging it. Additionally, if the temperature drops too low, components in the gas can condense forming droplets in the gas flow, and impurities such as water vapor can freeze on instruments and other parts causing damage.

This problem is particularly acute with wet natural gas, which is sometimes defined as natural gas that contains more than 10% $C_2$ hydrocarbons or more than 5% $C_3$ hydrocarbons. Wet natural gas may also contain some water, and sometimes may be saturated with water. When wet natural gas undergoes a pressure drop and expands through a valve, such as when a high pressure tank of gas is downloaded into a pipeline or to an end-user, the resultant cooling can cause the high molecular weight components of the natural gas to condense, cause impurities such as water vapor or carbon dioxide to freeze, thus subsequently clogging the line, or cause solid chemical complexes called hydrates to form, also clogging the line.

Currently, the pipe leading from an expansion valve when natural gas is downloaded is heated to prevent condensation, freezing, and the formation of hydrates. During the course of a downloading process, the pressure drop varies, the amount of cooling changes, and hence the amount of heating needed to prevent problems changes. However, the current practice is to provide an excess amount of heat at all times during a natural gas pressure letdown procedure. This is fine at the beginning of the process when the need for heat is greatest, but is a waste of energy later in the process as more heat is being put into the expanding gas than is needed to prevent condensation, freezing, and hydrate formation. Given the rising cost of energy, this is also a waste of money.

It is against this background that various embodiments of the present invention were developed.

BRIEF SUMMARY OF THE INVENTION

The present invention relates to a high-efficiency compression-based heater discharge/expansion station. The invention also features an apparatus and method for using a temperature actuated valve to automatically heat an expanding substance flowing through a pipe.

Therefore, one embodiment of the present invention is a fluid pressure letdown apparatus, comprising a first valve receiving a fluid via a first pipe with a pressure drop across said valve cooling the fluid; a heat exchanger for heating said cooled fluid received from the first valve via a second pipe; a temperature-measuring device disposed after the heat exchanger for measuring a temperature signal of the heated fluid via a third pipe; and a second valve that is automatically actuated by the temperature signal received from said temperature-measuring device that controls a flow of the fluid through the heat exchanger. When this fluid pressure letdown apparatus is used in the context of a large system, such as the natural gas discharge station described below, it is referred to as a "temperature-actuated valve."

Another embodiment of the present invention is the system described above, wherein the heat exchanger comprises coolant fluid from an internal combustion engine that provides heat. Another embodiment of the present invention is the system described above, wherein the heat exchanger is heated by electrical power. Another embodiment of the present invention is the system described above, wherein the heat exchanger comprises heat that is provided by a hot fluid. Another embodiment of the present invention is the system described above, wherein the heat exchanger comprises heat that is provided by a heat pump. Another embodiment of the present invention is the system described above, wherein the heat exchanger comprises heat that is provided by waste heat from an external source. Another embodiment of the present invention is the system described above, wherein the heat exchanger comprises heat that is provided by waste heat from a steam condensate return.

Another embodiment of the present invention is the system described above, wherein the temperature-measuring device is a thermostat. Another embodiment of the present invention is the system described above, wherein the temperature-measuring device is a thermistor. Another embodiment of the present invention is the system described above, wherein the temperature-measuring device is a thermocouple.

Another embodiment of the present invention is the system described above, wherein said second valve is automatically actuated by a signal carried through a wire from the temperature-measuring device. Another embodiment of the present invention is the system described above, wherein said second valve is automatically actuated by a wireless signal from the temperature-measuring device.

Another embodiment of the present invention is a method for preventing a freezing of substance lines during a pressure drop across an expansion valve and subsequent cooling, the method comprising the steps of measuring a temperature signal downstream of said expansion valve, and actuating a control valve to regulate a flow of a substance through a heat exchanger using the temperature signal such that if the temperature is too high said control valve will open wider so that said substance spends less time in the heat exchanger reducing its temperature, and if the substance temperature is too low the control valve will tighten so the substance spends more time in the heat exchanger increasing its temperature.

Another embodiment of the present invention is the method described above, wherein the substance is natural gas. Another embodiment of the present invention is the method described above, wherein the substance is wet natural gas. Another embodiment of the present invention is the method described above, wherein the substance is a liquid. Another embodiment of the present invention is the method described above, wherein the substance is a gas. Another embodiment of the present invention is the method described above, wherein the substance is a powder. Another embodiment of the present invention is the method described above, wherein the substance is a gel.

Yet another embodiment of the present invention is a natural gas discharge system for discharging high-pressure natural gas into a medium-pressure receiving location (such as interstate lines that typically operate over 1,000 psig), comprising an inlet port for receiving the high-pressure natural gas at a high inlet pressure; an expansion valve for regulating the pressure to a stable intermediate pressure; a cryogenic line disposed after the expansion valve for carrying a two-phase fluid mix comprising natural gas liquids and natural gas; a natural gas liquids recovery unit for recovering a portion of the natural gas liquids having a discharge line into a storage vessel adapted to store the recovered natural gas liquids for later pickup; a main heat exchanger for heating up a remaining fluid mix; a filtration vessel for vaporizing all remaining liquids and for filtering particulate matter resulting in a substantially pure natural gas stream; a compressor for compressing the natural gas stream and heating up the natural gas stream using heat of compression; and a discharge port for discharging the compressed, heated-up natural gas stream into the medium-pressure receiving location.

According to another embodiment of the present invention, the temperature-actuated valve described above is used in place of the compressor in the natural gas discharge system described above when discharging into a low-pressure receiving location.

According to yet another embodiment of the present invention, the temperature-actuated valve described above is used in the natural gas discharge system described above in addition to the compressor as a backup safety valve when discharging into a medium-pressure receiving location, such as interstate lines that typically operate over 1,000 psig.

Another embodiment of the present invention is a portable natural gas discharge system for discharging compressed natural gas into a receiving location, comprising a portable chassis for holding the natural gas discharge system; an inlet port for receiving the natural gas at an inlet pressure higher than a pressure of the receiving location; an expansion valve for regulating pressure of the natural gas to a stable intermediate pressure; a cryogenic line disposed after the expansion valve for carrying a two-phase fluid mix comprising natural gas liquids and natural gas; a natural gas liquids recovery unit for recovering a portion of the natural gas liquids having a discharge line into a storage vessel adapted to store the recovered natural gas liquids for later pickup; a main heat exchanger for heating up a remaining fluid mix comprising essentially natural gas; a regulator for regulating a flow of the heated natural gas stream through the main heat exchanger and out of the portable natural gas discharge system; and a discharge port for discharging the heated natural gas stream into the receiving location.

Yet another embodiment of the present invention is the system described above, wherein the regulator comprises a compressor for compressing the natural gas stream and heating up the natural gas stream using heat of compression to a medium-pressure.

Yet another embodiment of the present invention is the system described above, wherein the regulator comprises a temperature-measuring device for measuring a temperature signal of the heated natural gas stream; and a temperature-actuated valve disposed after the temperature-measuring device that is automatically actuated by the temperature signal received from said temperature-measuring device that controls a flow of the natural gas stream through the main heat exchanger.

Yet another embodiment of the present invention is the system described above, further comprising a filtration vessel disposed after the main heat exchanger and before the discharge port for vaporizing all remaining liquids and for filtering particulate matter resulting in a substantially pure natural gas stream.

Yet another embodiment of the present invention is the system described above, further comprising an internal combustion engine for generating heat for the main heat exchanger.

Yet another embodiment of the present invention is the system described above, wherein the main heat exchanger is heated by electrical power.

Yet another embodiment of the present invention is the system described above, wherein the main heat exchanger comprises heat that is provided by a hot fluid.

Yet another embodiment of the present invention is the system described above, wherein the main heat exchanger comprises heat that is provided by a heat pump.

Yet another embodiment of the present invention is the system described above, wherein the main heat exchanger comprises heat that is provided by waste heat from an external source.

Yet another embodiment of the present invention is the system described above, wherein the main heat exchanger comprises heat that is provided by waste heat from a steam condensate return.

Another embodiment of the present invention is a portable natural gas discharge system for discharging compressed natural gas into a receiving location, comprising an inlet port for receiving a natural gas stream at an inlet pressure higher than a pressure of the receiving location; an expansion valve for regulating pressure of the natural gas stream to a stable intermediate pressure; a heat exchanger for heating up the natural gas stream cooled as a result of expansion in the expansion valve; a temperature-measuring device for measuring a temperature signal of the heated natural gas stream; a temperature-actuated valve that is automatically actuated by the temperature signal received from the temperature-measuring device that controls a flow of the natural gas stream through the heat exchanger; and a discharge port for discharging the heated natural gas stream into the receiving location.

Yet another embodiment of the present invention is the system described above, further comprising a cryogenic line disposed after the expansion valve for carrying a two-phase fluid mix comprising natural gas liquids and natural gas; and a natural gas liquids recovery unit for recovering a portion of the natural gas liquids.

Yet another embodiment of the present invention is the system described above, further comprising a compressor for compressing the natural gas stream to a medium-pressure.

Yet another embodiment of the present invention is the system described above, further comprising a filtration vessel disposed after the heat exchanger and before the discharge port for vaporizing all remaining liquids and for filtering particulate matter resulting in a substantially pure natural gas stream.

Yet another embodiment of the present invention is the system described above, further comprising an internal combustion engine for generating heat for the heat exchanger.

Yet another embodiment of the present invention is the system described above, wherein the heat exchanger comprises heat that is provided by waste heat from an external source.

Finally, yet another embodiment of the present invention is a method for discharging compressed natural gas, comprising (1) receiving a natural gas stream at an inlet pressure higher than a pressure of a receiving location; (2) reducing a pressure of the natural gas stream to a stable intermediate pressure through an expansion valve; (3) heating up the pressure-reduced natural gas stream utilizing a heat exchanger; (4) regulating a flow of the heated natural gas stream through the heat exchanger by utilizing a temperature-signal measured downstream of the expansion valve; and (5) discharging the heated natural gas stream into the receiving location.

Yet another embodiment of the present invention is the system described above, further comprising compressing the natural gas stream to a medium-pressure.

Yet another embodiment of the present invention is the system described above, further comprising measuring the temperature signal of the heated natural gas stream utilizing a temperature-measuring device; and regulating the flow of the heated natural gas stream utilizing a temperature-actuated valve that is automatically actuated by the temperature signal to control the flow of the natural gas stream through the heat exchanger.

Yet another embodiment of the present invention is the system described above, further comprising recovering a liquid portion of the natural gas stream into a storage vessel adapted to store the recovered natural gas liquids for later pickup.

Other embodiments of the present invention include the methods corresponding to the systems above, the systems constructed from the apparatus described above, and the methods of operation of the systems and apparatus described above. Other features and advantages of the various embodiments of the present invention will be apparent from the following more particular description of embodiments of the invention as illustrated in the accompanying drawings.

BRIEF DESCRIPTION OF THE DRAWINGS

FIG. 7 shows a flowchart of a process for discharging natural gas into a high-pressure or medium-pressure receiving location according to another embodiment of the present invention.

DETAILED DESCRIPTION OF THE INVENTION

Figure 1:
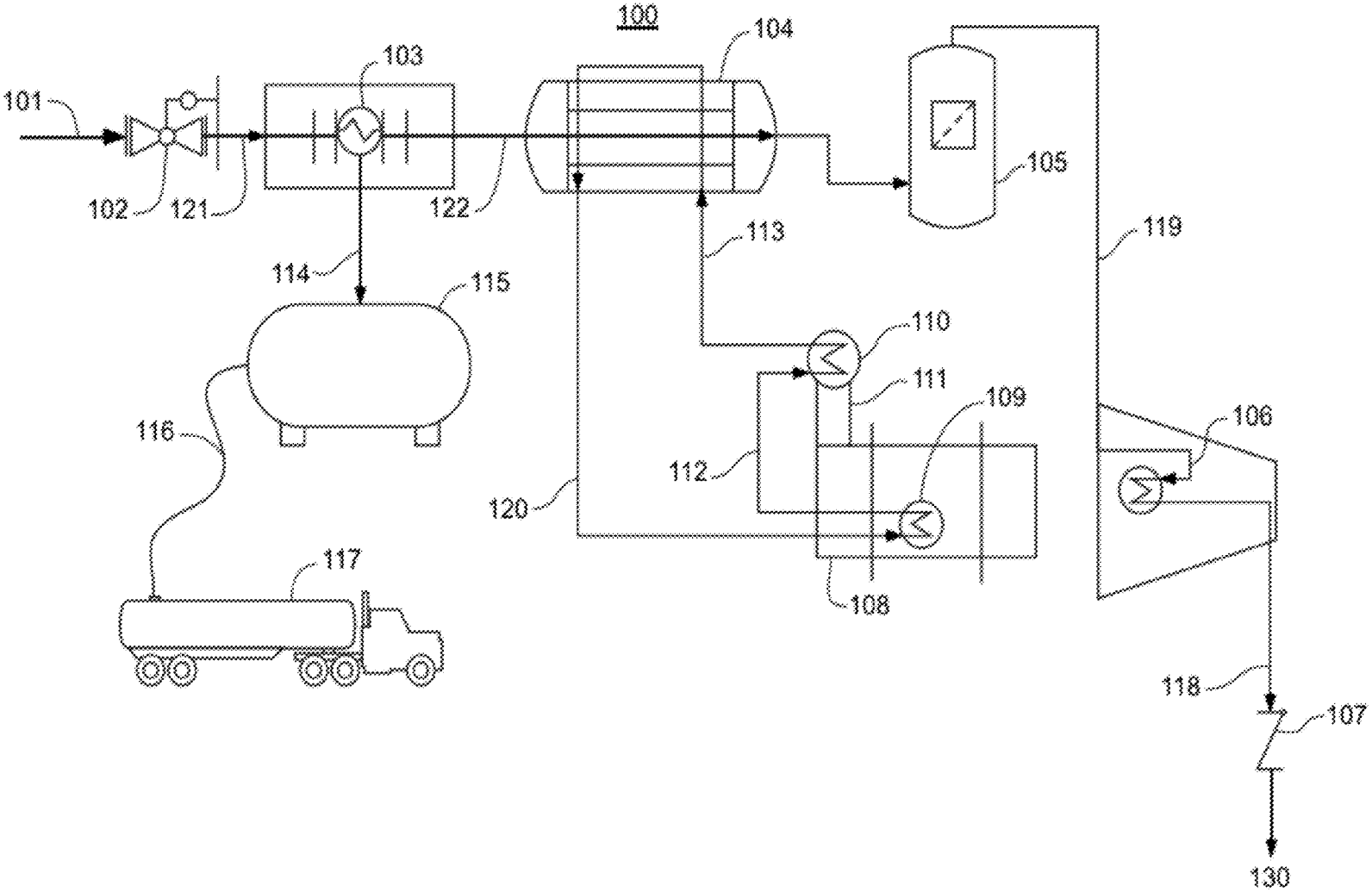
FIG. 1 shows an illustrative process flow diagram (PFD) of a natural gas discharge station discharging into a high-pressure or medium-pressure receiving location according to one embodiment of the present invention.

Definitions: The following terms of art shall have the below ascribed meanings throughout this specification.

Natural gas is a mixture of hydrocarbon gases and liquids, including but not limited to methane, ethane, propane, butane, etc. Natural gas is usually primarily methane, but usually also includes higher hydrocarbons. In addition, natural gas may include other impurities such as carbon dioxide and water vapor.

CNG is an acronym for Compressed Natural Gas, which is natural gas typically compressed to a pressure above approx. 2,000 psig.

Wet gas is natural gas that contains a high proportion of $C_2$+ components (more than 10%); typically anything more than 5% $C_3$+ is also considered wet gas. This is not an absolute definition, but a rule of thumb used in the literature. A dominant majority of wet gas is also often, but not always, saturated with water vapor.

Natural gas liquids (NGL)—$C_2$+ components, including ethane, propane and heavier hydrocarbons.

Saturated gas is natural gas that is saturated with water vapor.

Dry gas is natural gas with <5% of $C_3$+ components, or <10% $C_2$+ components.

LPG is an acronym for Liquefied Petroleum Gas, which is generally a term for gas mixtures of $C_3$+ components.

High-pressure or medium pressure receiving location is any receiving location that is over approximately 1,000 psig, such as interstate lines.

Low-pressure receiving location is any receiving location that accepts natural gas below approximately 1,000 psig, such as an end-user or industrial facility.

Joule-Thomson ("J-T") Effect, also known as the Joule-Kelvin effect or the Kelvin-Joule effect, describes the temperature change of a gas or liquid when it is forced through a valve or porous plug while kept insulated so that no heat is exchanged with the environment. This procedure is called a throttling process or Joule-Thomson process. At room temperature, all gases except hydrogen, helium and neon cool upon expansion by the Joule-Thomson process.

Introduction

In order to reduce pressure in a container, such as a gas cylinder, expansion of gas through a valve is performed. This can be done in either of two modes:

(1) Fast discharge—intended to discharge the container as rapidly as possible, quickly cycling or emptying the cylinders. Usually this has to be discharged into an open-ended area that can absorb the discharge, typically a pipeline. When the pipeline operates at high pressure, the discharge will likely be to the inlet of a compressor that can boost the pressure back up to pipeline levels.

(2) Variable discharge—intended to feed the consumption of an industrial operation, a distribution/consumption line, or a vehicle/machine such as a drilling rig generator.

As a byproduct of expansion (for practical purposes expansion through a valve is to be considered isenthalpic), temperature of the gas drops as it expands (the J-T effect). Without adding heat to this now cold gas, it starts causing a host of issues, including but not limited to:

(1) Material failure due to exceeding the low temperature limits of the pipeline or coatings.

(2) Freezing $CO_2$, water, and other non-hydrocarbon streams in the gas.

(3) Creating hydrates in the pipeline due to the reduced temperatures.

Heat is added after the expansion valve in order to bring it up to a desirable condition, typically in the 60-100° F. range. Unless a significantly oversized heater and heat addition source is provided, controlling for the variations in heat required during the course of discharge is very challenging. At the start of the discharge, when the pressure differential is highest, the most amount of heat is required (on a per unit of mass basis), while little to no heat is required at the end of the cycle. Current practice is to supply an excess amount of heat at all times during the downloading process, keeping the gas above the freezing and hydrate formation temperature. Later in the downloading process much of this heat is not needed, which is a waste of energy and money.

In order to maintain a stable temperature given a preselected heat exchanger (sized for required flow conditions), as well as to maximize the heat added, one feature of one embodiment of the present invention is a temperature-actuated balancing valve used at the outlet. The temperature-actuated valve will only allow gas to flow through if it has attained a sufficiently high temperature. This temperature-based control allows for reduced flows at the onset of the cycle (given that the heat requirements are highest), and very high and full open flows at the end of the cycle (when practically no heat is required).

This temperature control in turn allows the utilization of a variable heat source, such as that found in waste heat streams such as cylinder jacket water from a combustion engine, steam condensate return, among others. The temperature-actuated valve eliminates gas flow through the heat exchanger in case insufficient heat is available, avoiding freezing incidents that could in turn burst the tubes or surfaces of the heat exchanger, causing a serious accident.

Therefore, one embodiment of the present invention is a gas discharge station utilizing a temperature-actuated valve (fluid pressure letdown apparatus). The temperature-actuated valve uses a temperature-measuring device to sense the temperature of the natural gas after it expands through an expansion valve and after it passes through a heat exchanger inside the discharge station. This temperature-measuring device sends signals to a valve that is automatically actuated. If the temperature of the gas is too low, the valve is tightened, increasing the residence time in the heat exchanger and increasing the gas temperature. If the gas temperature is too high, the valve is widened, reducing the residence time in the heat exchanger, and decreasing gas temperature. Using this temperature-actuated valve to control the temperature of a wet gas discharge station is described in greater detail below.

The present invention also allows pretreatment and cooling upstream of the expansion valve, in order to further maximize the J-T effect cooling and integrate cryogenic separation, for example. Pre-conditioning of gas before sending through a cryogenic expander is another possible use of the present invention. Allowing a safe, single-step reduction in pressure, which could in turn be utilized in a pressure letdown station at a city gate from a major pipeline, is another use.

There are many applications of the present invention, including discharge/unloading stations that have an isenthalpic expansion valve, or other pressure reduction device, and due to the related Joule-Thompson cooling effect, require heat to be added in order to avoid phase-separation, freezing, or adverse effects down the line. In particular, the present invention may be used to unload a predetermined amount of gas, stored in high-pressure cylinders, into a pipeline or other industrial/final user of the gas at a lower pressure.

The present invention can also be used in pipeline "city gate" pressure letdown locations, in liquefaction operations, and in natural gas liquids processing and separation plants.

Fluid Pressure Letdown Apparatus ("Temperature-Actuated Valve")

Figure 3:
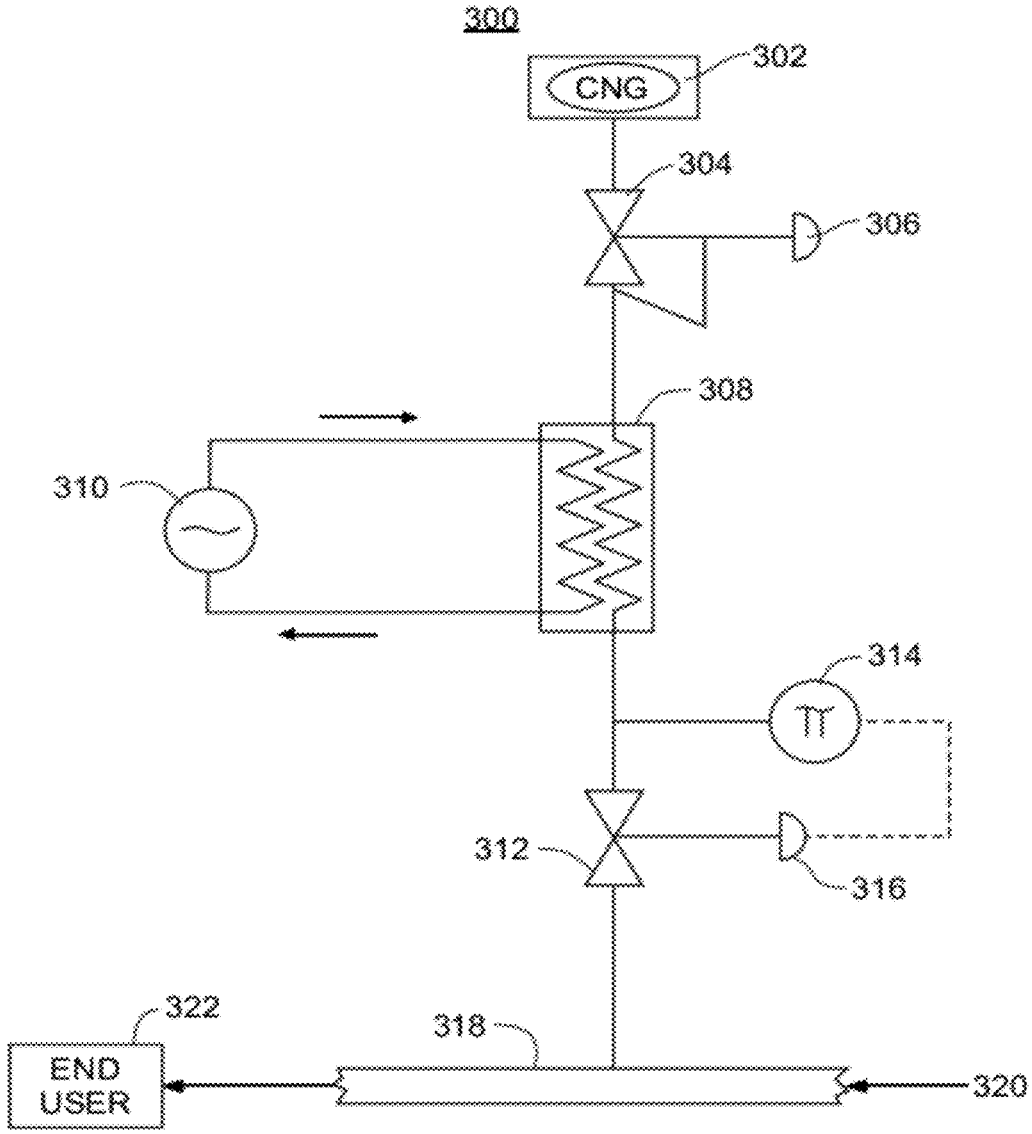
FIG. 3 shows a block diagram of a fluid pressure letdown apparatus ("temperature-actuated valve") according to one embodiment of the present invention.

Accordingly, FIG. 3 shows a fluid pressure letdown apparatus ("temperature-actuated valve") 300 according to one embodiment of the present invention. A fluid 302, which may be CNG in one embodiment, is received from an external source, and enters the apparatus through a first pipe into a first valve 304 ("expansion valve") that is controlled by a valve positioner 306. The fluid then flows through a second pipe into a heat exchanger 308, which exchanges heat with an external heat source 310. A third pipe carries the fluid from the heat exchanger past a temperature-sensing device 314 that senses the temperature at an exit to the heat exchanger 308, and controls a second valve 312 ("control valve") via a controllable valve positioner/controller 316 using a negative feedback loop control logic circuit. If the temperature-sensing device 314 determines that the temperature of the fluid is too low, it can send a signal to the valve 312 telling it to tighten to slow down the flow of the fluid, increasing the residence time of the fluid in the heat exchanger 308, thus raising its temperature. If the temperature-sensing device 314 determines that the temperature of the fluid is too high, it can send a signal to the valve 312 telling it to open further, increasing the flow of fluid, reducing the residence time of the fluid in the heat exchanger 308, and thus lowering the fluid temperature.

In the case of the fluid being wet natural gas, after exiting the valve 312, the expanded natural gas may safely enter a gas line 318, which may have additional wet gas 320 from another source, and safely supplied to an end user 322 without the issues, problems, risks, and safety concerns associated with prior art pressure letdown devices.

In one embodiment of the present invention, the heat exchanger obtains heat from a coolant fluid coming from an internal combustion engine. In another embodiment, the heat exchanger can obtain waste heat from a steam condensate return. In yet another embodiment, the heat exchanger can obtain heat by electrical means, such as a heating coil or heating tape. In yet another embodiment, the heat exchanger can obtain heat from a flow of hot gas, such as from the exhaust of any device that gives off waste heat. In yet another embodiment, the heat exchanger can obtain heat from a heat pump. In short, any device that gives off heat could be used in the heat exchanger to heat gas flowing through it.

In various embodiments, the temperature-sensing device could be a thermostat, a thermocouple, or a thermistor.

In one embodiment, the automatically-actuated valve can receive its signal from the temperature-sensing device through a wire. In another embodiment, the automatically-actuated valve can receive its signal from the temperature-sensing device wirelessly.

In one embodiment, the fluid flowing through the pressure letdown apparatus is natural gas. However, the present invention could be used to control the flow of any material passing through a pipe, such as any gas, vapor, liquid, powder, gel, or paste. The pressure letdown apparatus is particularly applicable to wet gas applications, since hydrate formation and freezing gas lines are a particular problem in wet gas discharge situations.

In summary, the fluid pressure letdown apparatus allows the flow-rate to be automatically adjusted depending on the heat capacity that is available. Thus, one advantage of the present invention is that the heat source can be swapped or switched when necessary without concern about heat mismatch.

In the prior art systems that do not utilize the fluid pressure letdown apparatus of the present invention, when wet gas is discharged, the pipes risk end up clogged as a result. For example, this occurs in Nigeria that is a typical place for flare gas recovery. Hydrate formation is an issue in natural gas pipelines, but since stranded associated wet gas (which is normally flared) hadn't been transported at pressure before, this has not been previously recognized.

One of the advantages of the present invention is that the heater can run at a lower temperature than in the prior art but still do its job effectively because of the feedback loop. The present invention also nearly eliminates the possibility of a heat exchanger freeze-up accident. In essence, the present invention allows one to have equivalent safety to an oversized heat source, without the costs and inefficiency of running an oversized heating system or having to do multiple pressure letdowns in series, as typically done in the prior art.

Several flow control apparatus are described in the prior art that utilize temperature sensing. U.S. Pat. No. 6,125,873 issued to Daniel H. Brown describes a device for preventing water line freeze damage. The device incorporates air temperature sensing means to control a trickle flow in a water system, so that a trickle flow is initiated whenever the ambient air temperature drops below a predetermined point. The trickle flow inhibits freezing in the water system.

U.S. Pat. Nos. 6,626,202; 6,722,386; and 6,918,402 all issued to Bruce Harvey describes a flow control apparatus comprising a thermostat that automatically actuates a valve to enable water to flow through the valve when the temperature of the air or water is at or near the freezing temperature of water. When the temperature of the air or water rises above freezing, the thermostat causes the valve to close, thereby preventing water from flowing through the valve. Therefore, when the apparatus is coupled to an end of a water conduit, such as a water spigot or hose, water is allowed to flow through the conduit when the air or water temperature is at or near freezing to prevent the conduit from bursting due to water freezing and expanding within the conduit.

However, none of the prior art discloses or suggests a fluid pressure letdown apparatus, comprising a first valve receiving a fluid via a first pipe with a pressure drop across said valve cooling the fluid; a heat exchanger for heating said cooled fluid received from the first valve via a second pipe; a temperature-measuring device after the heat exchanger for measuring a temperature signal of the heated fluid via a third pipe; and a second valve that is automatically actuated by the temperature signal received from said temperature measuring device that controls a flow of the fluid through the fluid pressure letdown apparatus.

Natural Gas Discharge Station for Discharging into High-Pressure or Medium-Pressure Receiving Locations Utilizing a Compressor Another embodiment of the present invention is a natural gas discharge station for discharging into high-pressure or medium-pressure receiving locations. One illustrative embodiment of the discharge station includes an expansion valve, followed by a heat exchanger, a gas/liquid separator/scrubber, and a subsequent compressor stage. After the final process, additional heat may be added or withdrawn from the system using an additional heat exchanger. As a heating fluid, waste heat from an internal combustion engine or driver may be used. To increase further the heat content of the heating liquid, cylinder jacket liquid may be circulated through a heat recovery exchanger at the exhaust of the engine, before transferring the thermal energy to the cool expanded gas. Thermostatic valves may be used throughout the process to regulate and stabilize operating temperatures in the auxiliary and main fluid circuits. To enhance the recovery of natural gas liquids (NGLs)—including ethane, propane and heavier hydrocarbons—an additional refrigeration circuit may be added mid-process, consisting of multiple heat exchangers and thermal transfer devices, as well as controls.

Figure 2:
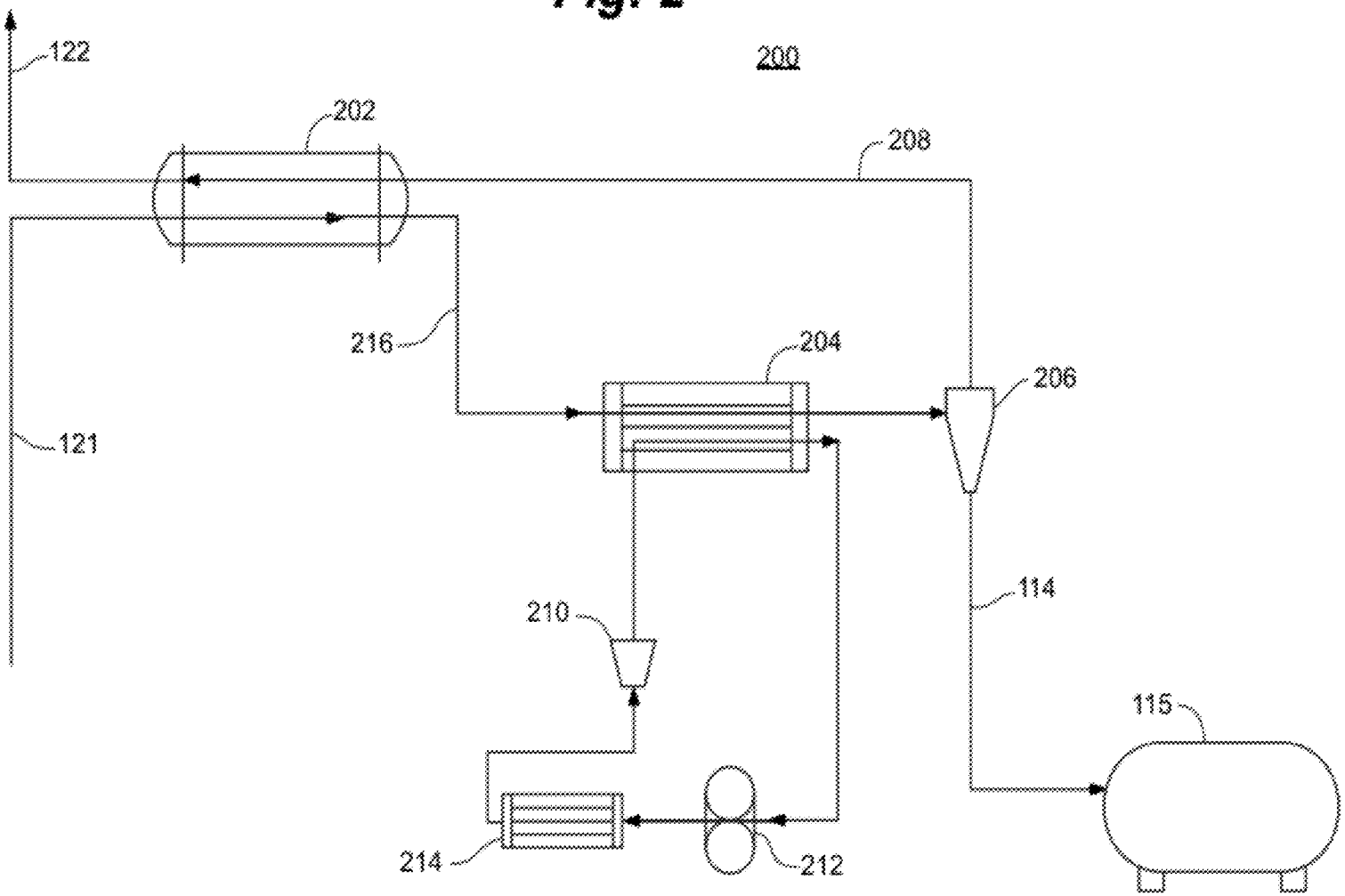
FIG. 2 shows a complementary process flow diagram (PFD) of a natural gas liquids recovery unit shown in FIG. 1 according to one embodiment of the present invention.

Referring now to aspects of the invention in more detail in FIGS. 1-2 there are shown the natural gas discharge station components in one illustrative embodiment of the present invention. In this embodiment, the discharge station includes:

- 101. Inlet connection from high pressure mobile CNG trailers, or other high-pressure source
- 102. Expansion, throttle, and regulation valve
- 103. Natural gas liquids recovery unit
  - 202. Pre-heater/re-cooler heat exchanger for refrigeration efficiency increase
  - 204. Refrigerated evaporator/condenser for further cooling incoming gas
  - 206. Liquids separator
  - 208. NGL free outlet flow from separator
  - 210. Expansion valve for J-T effect
  - 212. Refrigeration compressor
  - 214. Refrigeration circuit condenser
  - 216. Pre-cooled inlet line
- 104. Main heat exchanger to raise temperature to −20° F.
- 105. Filtration vessel and remaining liquids collector
- 106. Adiabatic or isentropic compressor
- 107. Check valve
- 108. Internal combustion engine driver

109. Cylinder cooling jacket heat exchanger
110. Exhaust heat recovery heat exchanger
111. Exhaust heat stack
112. Hot post cylinder jacket coolant
113. Extra hot post exhaust heat and cylinder jacket coolant
114. Natural gas liquids discharge line to storage
115. On site storage container
116. Hose/connection to mobile trailer or NGL pickup
117. NGL trailer truck or pickup service
118. Final discharge gas line at >50° F. to avoid hydrate formation
119. Pre-heated line to compressor inlet at >−20° F.
120. Cooled coolant return line to engine
121. Cold expanded gas line after expansion valve
122. Reduced cold NGL-free line to heat exchanger FIG. 1 shows an illustrative process flow diagram (PFD) of a natural gas discharge system (100) discharging into a high-pressure or medium-pressure receiving location according to one embodiment of the present invention utilizing a compressor. As shown in FIG. 1, incoming high-pressure gas comes from trailers (101), or other high-pressure source, at an initial pressure of up to 6,000 psig. Upon reaching an expansion valve (102) that regulates the pressure afterwards to a stable pressure, the pressure drop inside the valve generates cooling from the Joule-Thomson effect. The J-T effect can drop the temperature of the gas to below −120° F. Due to this large temperature drop, many of the component gases become liquid since they are also below supercritical temperature and pressure. A cryogenic line after the expansion valve (121) carries the two-phase fluid mix (liquid and gas), into a natural gas liquids recovery unit (103), which is described in greater detail below in relation to FIG. 2. After recovering a large portion of the natural gas liquids, the rest would remain suspended in the fluid stream and then would enter into a main heat exchanger (104). The fluid mix gets heated up to approx. −20° F., so as to eliminate the need for specialty materials after the main heat exchanger, before going into a filtration vessel (105), where the gas stream, all liquids having been vaporized, is filtered for particles before entering a pre-compression line (119). The pre-compression line temperature will ideally be −20° F. and upon compression through an isentropic or adiabatic compressor (106)—which could be a screw, reciprocating piston, centrifugal or axial type, among others—would heat up from the effect of the heat of compression that occurs during the process, thereby the discharge station would have an exit temperature from the compressor of >50° F. as measured in the exit line (118). This temperature would eliminate the risk of hydrate formation in the main gas pipeline, as the gas coming from the compressor would be dry and wouldn't have formed hydrates, but at the gas pipeline one avoids hydrate formation from the temperature shock. A check valve (107) is in place to prevent flow reversal through the station if gas pipeline pressures suffer from a temporary spike.

The heating circuit consists of a liquid coolant, which may be a mix of water and glycol or others, in any proportion, which flows through a coolant line (120) into a combustion engine (108), which typically serves as the driver for the compressor. Here, heat is extracted from the combustion process from cylinder jackets (109) and the resulting temperature in the hot post cylinder jacket coolant (112) is usually above 180° F. Afterwards, the hot coolant goes through a second heat exchanger (110) for recovering heat from the exhaust gases flowing through an engine combustion exhaust stack (111) in order to gather even more heat into line (113) which flows into the main heat exchanger (104) in order to transfer the thermal energy into the natural gas fluid coming from line (122).

All captured natural gas liquids flow through a discharge line (114) into an insulated or non-insulated capture vessel (115) in order to store the liquids for later pickup by a transport (117). In order for the liquids to be pumped into such transport, they flow through an exit line (116).

According to one embodiment of the present invention, shown in FIG. 2, the natural gas liquids recovery unit (200) may be improved further to extract continuously a consistent fraction of NGLs. First, the incoming high-pressure discharge gas precooled by the expansion valve (121) in FIG. 1 flows into a pre-heater/recooler unit (202) designed to minimize the leftover temperature going into the main heat exchanger (104). A line (216) carries the cold fluid mix into a refrigerated condenser (204) in order to force the dropout of additional natural gas liquids such as ethanes, propanes, and butanes, later heading into a separator for these liquids (206). The liquids accumulated at the bottom of the separator (206) are discharged through a line (114) into natural gas liquids storage (115). The free gas remaining after the separator is taken through an exit line (208) into a preheater/recooler unit (202) before leaving the natural gas liquids recovery unit and flowing through an exit line (122) to the main heat exchanger (104) shown in FIG. 1.

In one embodiment, the refrigerated condenser (204) may have an external closed-loop refrigeration or heating system, to regulate the temperature of the fluid mix to optimal NGL extraction temperatures. The refrigeration/heating loop consists of a reversible rotary refrigeration compressor (212) running on nitrogen or propane, a condenser/evaporator (214), and an expansion valve (210).

FIGS. 8-16 show illustrative perspective views of the natural gas discharge station of FIG. 1 discharging into a high-pressure or medium-pressure receiving location. Only an illustrative subset of the systems described in relation to FIG. 1 are shown for clarity. In FIGS. 8-16, an exhaust heat recovery subsystem 801 is used to recover exhaust heat. A driver engine 807, which could be a natural gas engine or any other driver as described above, serves as a source of power for the compressor 804 and provides heat to the heat exchanger 806. An engine radiator 802 is used to keep the driver engine from overheating. A base skid, or chassis, 803 holds the entire system in place, which may be mounted to a trailer for transport by a truck, boat, airplane, or other means. A compressor 804, which could be a reciprocating piston compressor or any other type of compressor such as a rotary positive displacement compressor, is used to fully discharge the trailer. A scrubber-filter-separator 805 is used to filter liquids and particulate matter, and a shell-and-tube heat exchanger 806 is used to exchange heat from the driver engine 807 and the expanding cooled natural gas.

Figure 17:
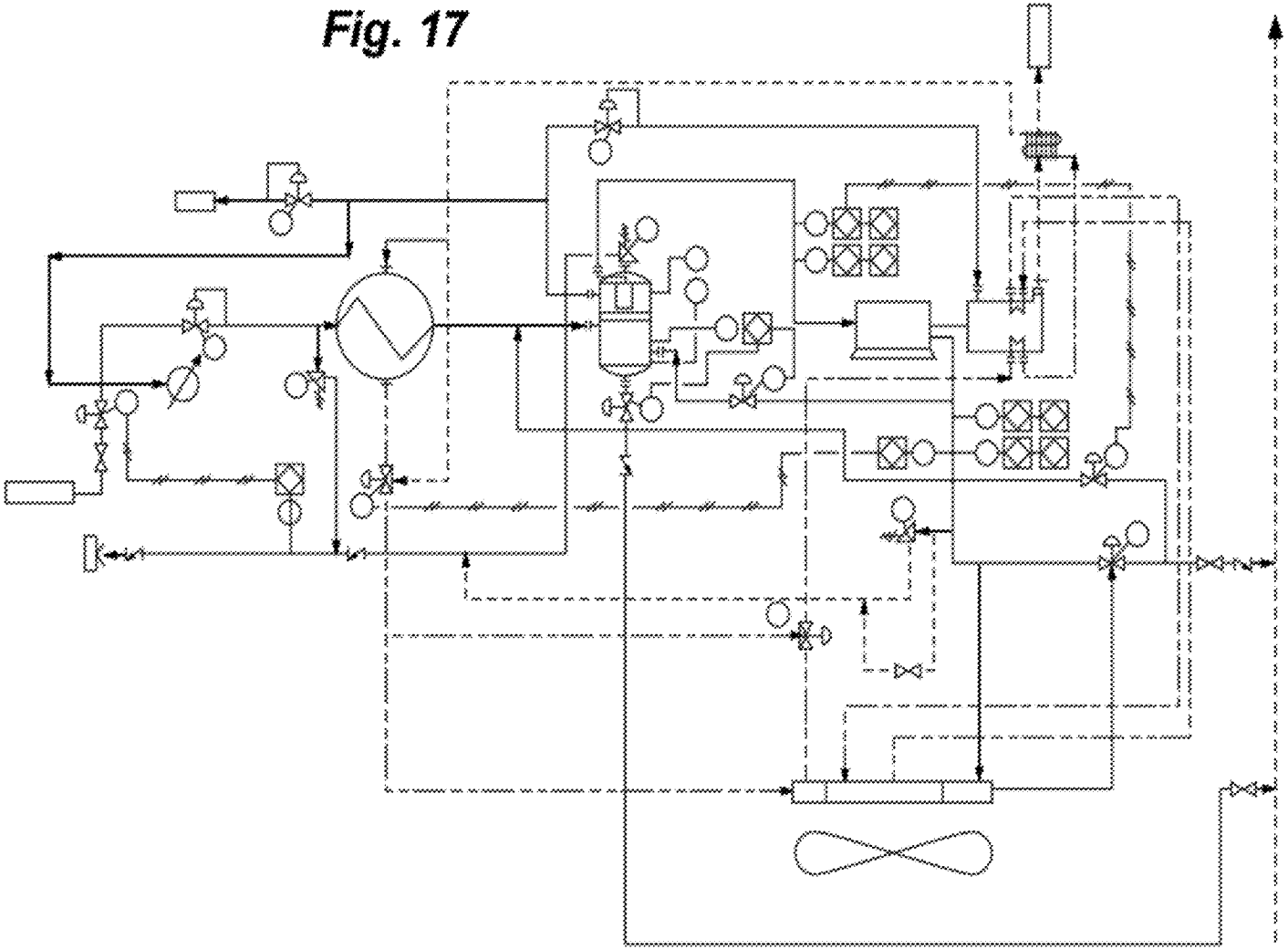
FIG. 17 shows a detailed process instrumentation diagram (PID) of the natural gas discharge station of FIG. 1 discharging into a high-pressure or medium-pressure receiving location.

FIG. 17 shows a detailed process instrumentation diagram (PID) of the natural gas discharge station of FIG. 1 discharging into a high-pressure or medium-pressure receiving location.

Figure 4:
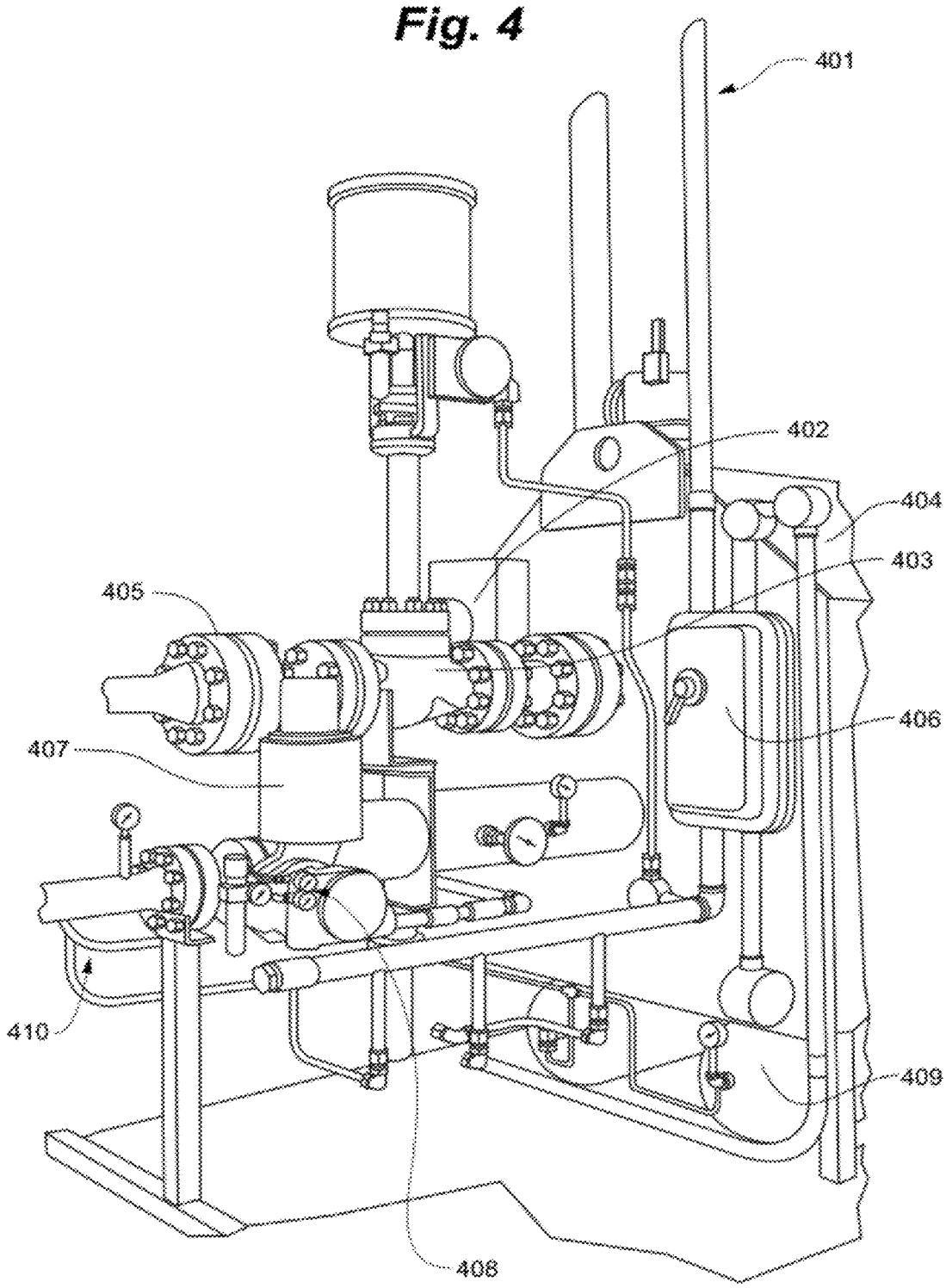
FIG. 4 shows a perspective view of an illustrative embodiment of a natural gas discharge station discharging into a low-pressure receiving location according to another embodiment of the present invention that utilizes the temperature-actuated valve of FIG. 3.
Figure 5:
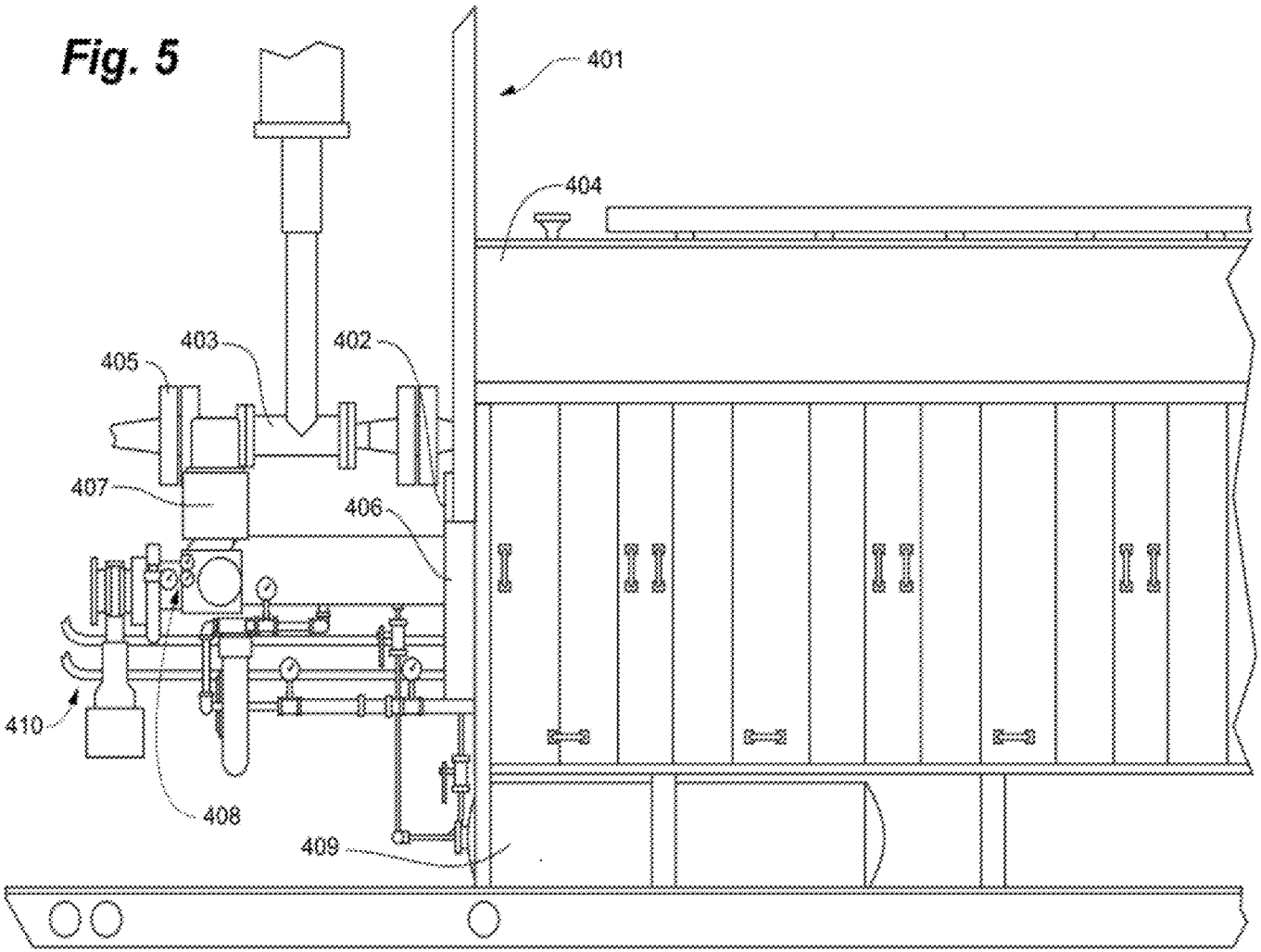
FIG. 5 shows another perspective view of the natural gas discharge station shown in FIG. 4.

Natural Gas Discharge Station for Discharging into a Low-Pressure Receiving Location Utilizing the Temperature-Actuated Valve Yet another embodiment of the present invention is a natural gas discharge station for discharging into a low-pressure receiving location utilizing the temperature-actuated valve. FIGS. 4-5 show perspective views of an illustrative embodiment of such a natural gas discharge station that utilizes the temperature-actuated valve of FIG. 3.

Unlike the embodiment shown in FIGS. 8-16, which discharges into a high-pressure or medium-pressure receiving location, the embodiment shown in FIGS. 4-5 can be used to discharge into a low-pressure receiving location. Hence, no compressor is needed in the discharge station. In place of the compressor, a temperature-actuated valve as described in relation to FIG. 3 is utilized.

FIGS. 4-5 show illustrative perspective views of a natural gas discharge station discharging into a low-pressure receiving location that utilizes the temperature-actuated valve of FIG. 3. Only an illustrative subset of the subsystems described in relation to FIGS. 1-3 are shown for clarity. As shown in FIGS. 4-5, an instrument gas exhaust stack 401 is used to vent exhaust gases. An instrument gas heater 402 is used to prevent critical measurement devices from clogging with frozen gas or water, as well as to prevent hydrate formation. A first valve 403, such as a VL-16 unloading/expansion valve, is used to allow the compressed natural gas to expand. A heat source 404, such as a natural gas engine or any other heat source as described above, is used to provide heat needed to heat the cooled expanded gas. High-pressure inlet gas is connected via connection 405. A source of electricity 406 powers all of the controls. A valve positioner 407, such as a pneumatic/electro-pneumatic valve positioner, is used to control an actuated valve 408, such as a VL-19 flow balance, via negative feedback control, as described in relation to FIG. 3. Reserve instrument gas 409 is used to supply gas to instruments for sensing. Finally, lower pressure gas is supplied at outlet connection 410.

A variation of this is discussed above in relation to a discharge station which unloads into a high-pressure or medium-pressure receiving location. In that embodiment, a compressor that accepts a fixed amount of mass while pressure is kept constant by the first valve 403 replaces the temperature-actuated valve 408. The heat added is variable and will depend at which point in the cycle the system is operating in. The use of that design is to have a fixed/pre-determined discharge time for a high-pressure vessel while using the heat of compression as a means to reduce the total heat required. The compressor adds pressure and further depletes the incoming gas containers, which is particularly useful when unloading into high-pressure or medium-pressure receiving locations, such as interstate pipelines that typically operate over 1,000 psig.

In the application of tube trailer discharge stations, heating of the gas has been applied to compensate for the significant cooling effect caused by the large pressure drop from the storage containers, and to elevate the operating temperatures above freezing or the hydrate formation point. At times, tube trailers must discharge into high-pressure pipelines, thus leaving a significant volume of gas in the trailers, or use a booster-compressor to continue depleting the tube trailer cylinders. Compressor cylinders are of standard design with a minimum inlet temperature, and to reach this temperature the cold expanded gas must be heated. In practice, a significant amount of energy is spent in heating the expanded gas to acceptable pipeline levels. The present invention alleviates these problems.

Fluid Pressure Letdown Method

Figure 6:
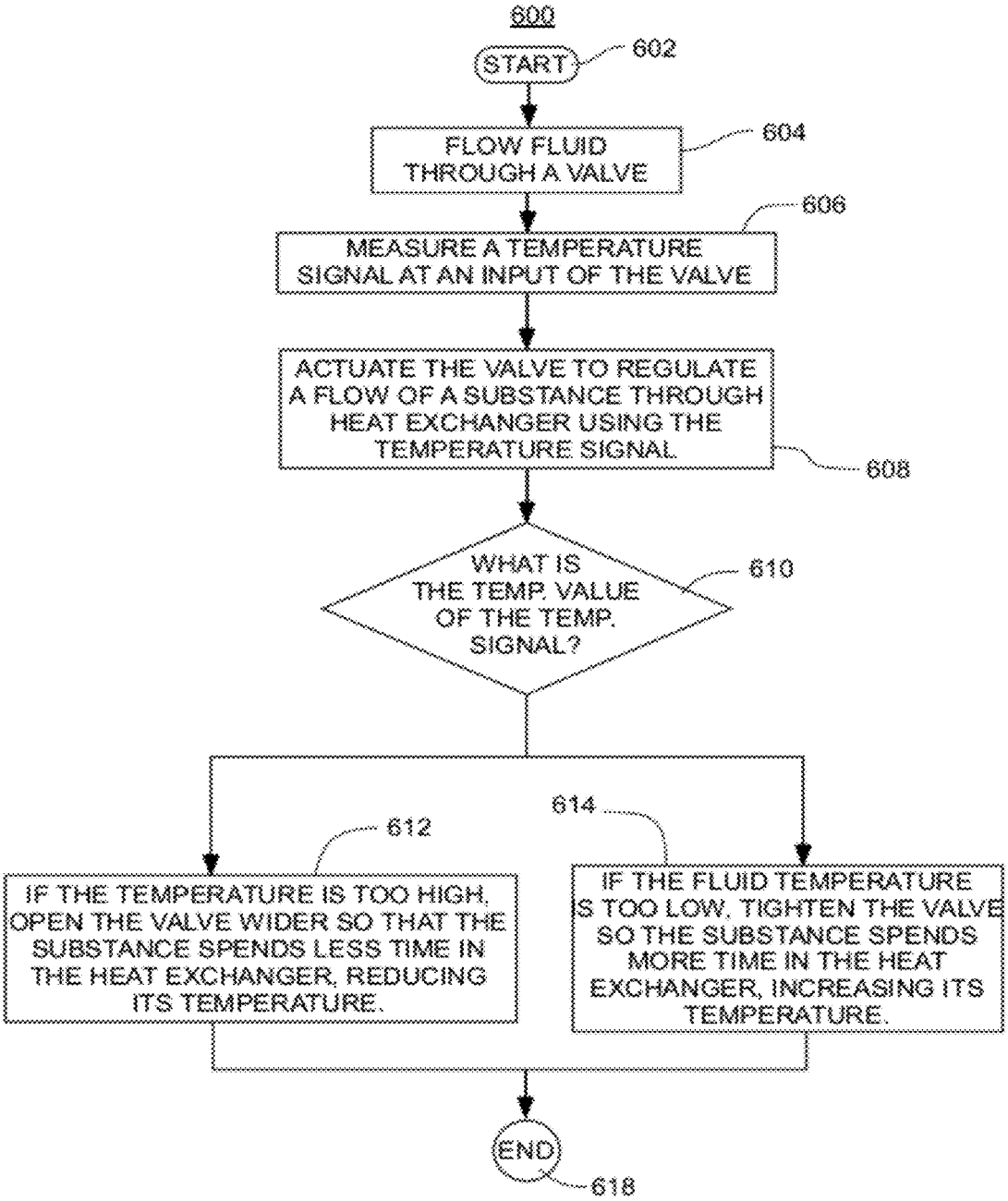
FIG. 6 shows a flowchart of a process for preventing the freezing of substance lines during a pressure drop across a valve and subsequent cooling according to one embodiment of the present invention.
Figure 8:
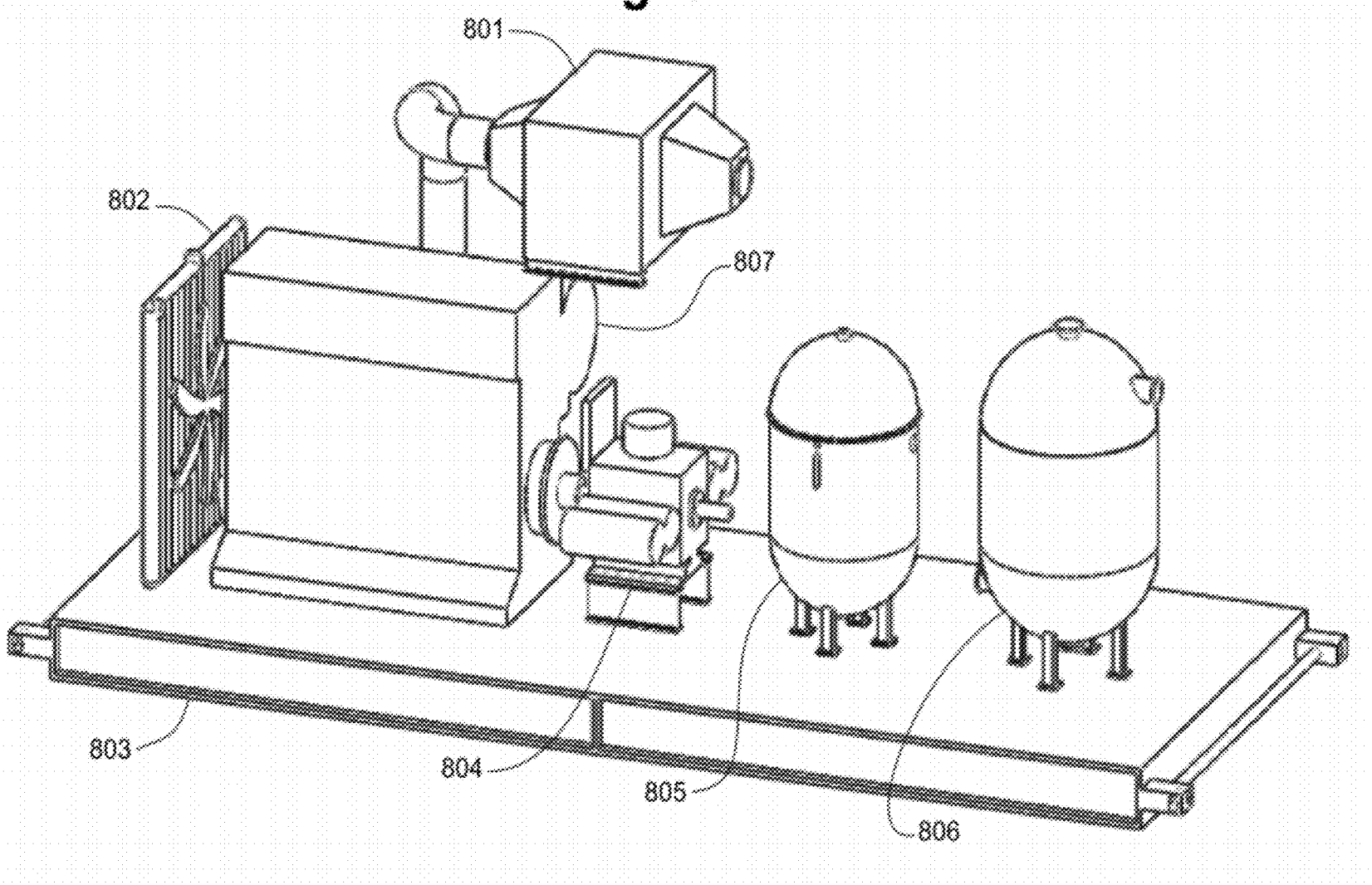
FIGS. 8-16 show illustrative perspective views of the natural gas discharge station of FIG. 1 discharging into a high-pressure or medium-pressure receiving location.
Figure 9:
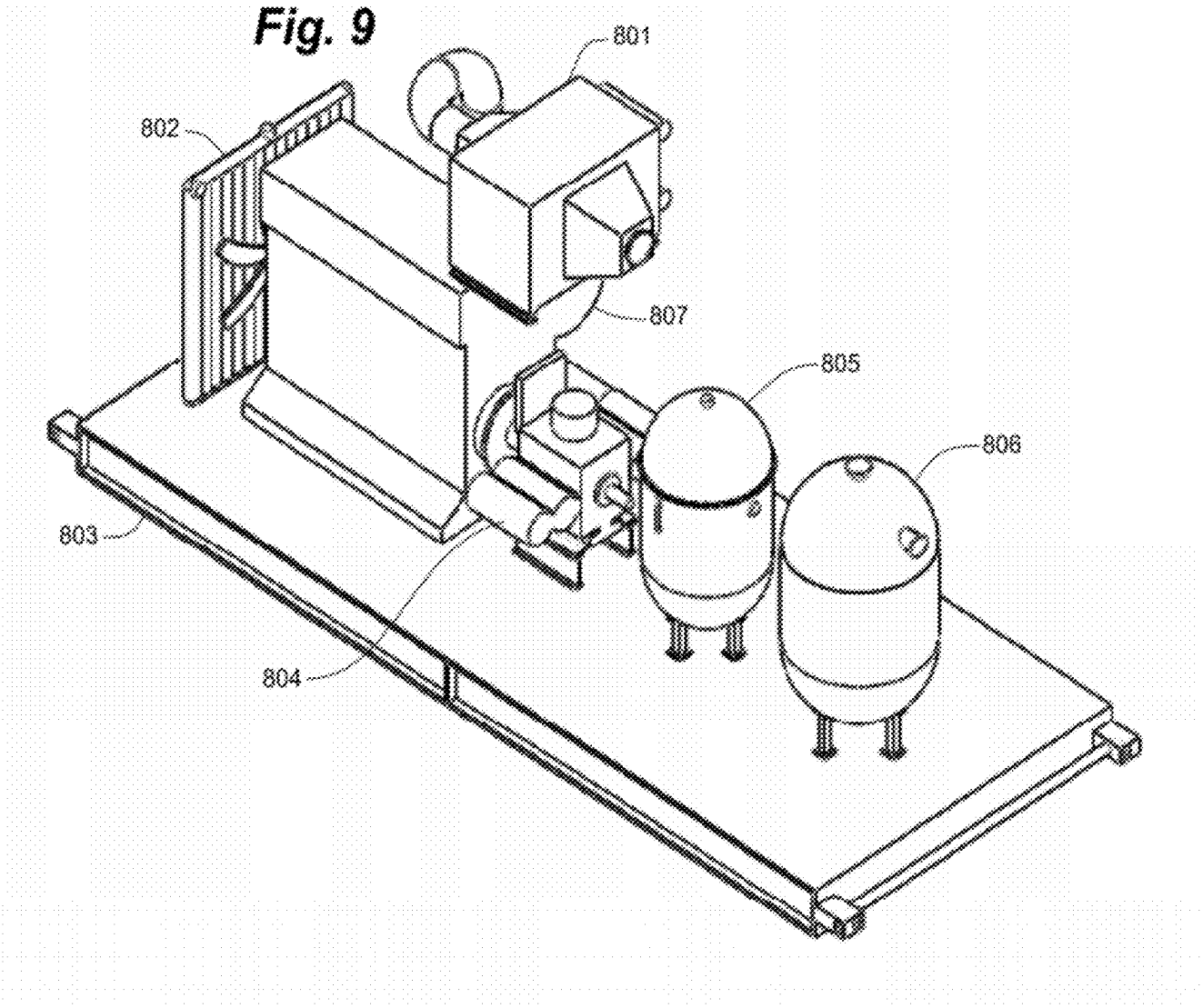
Figure 10:
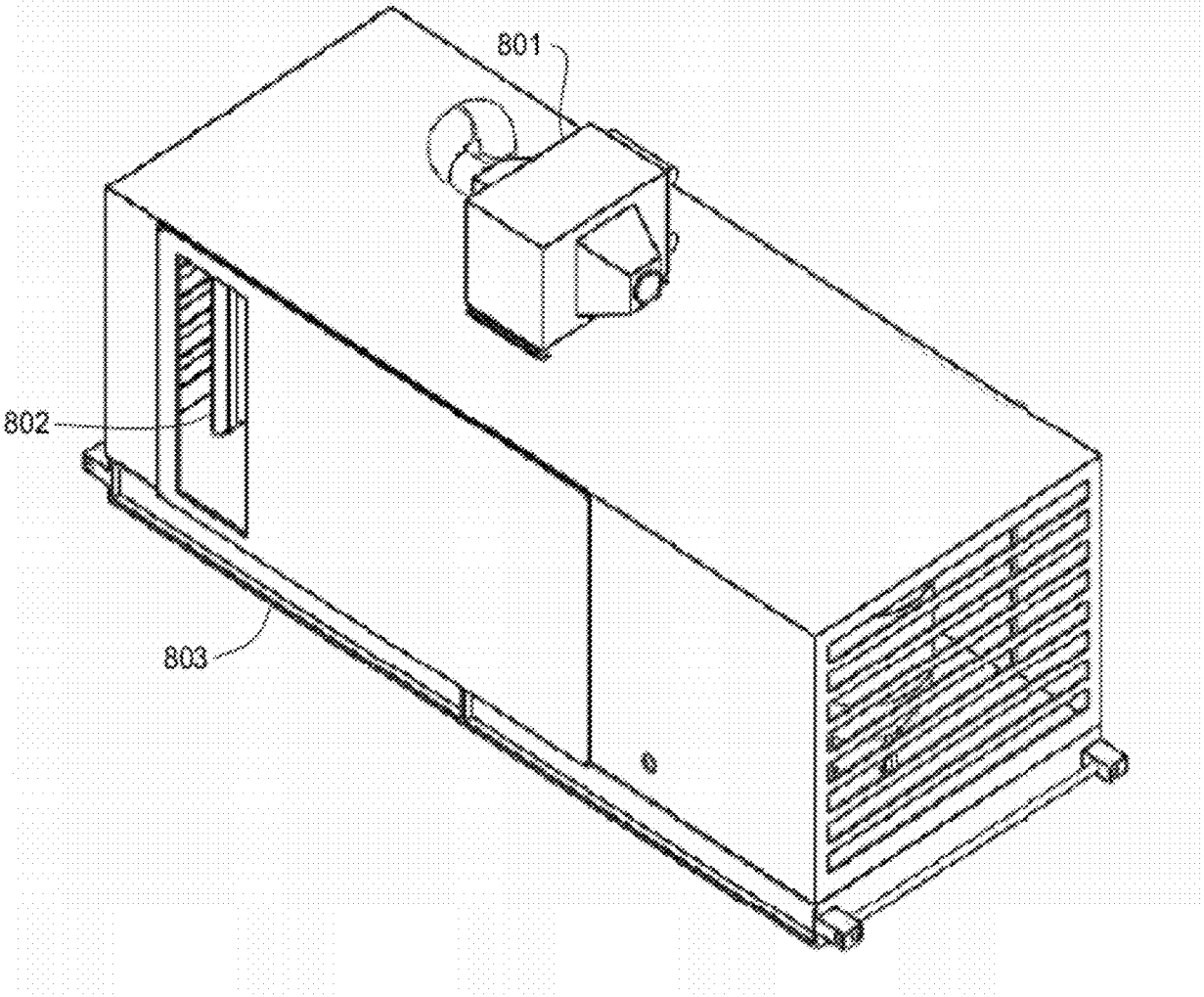
Figure 11:
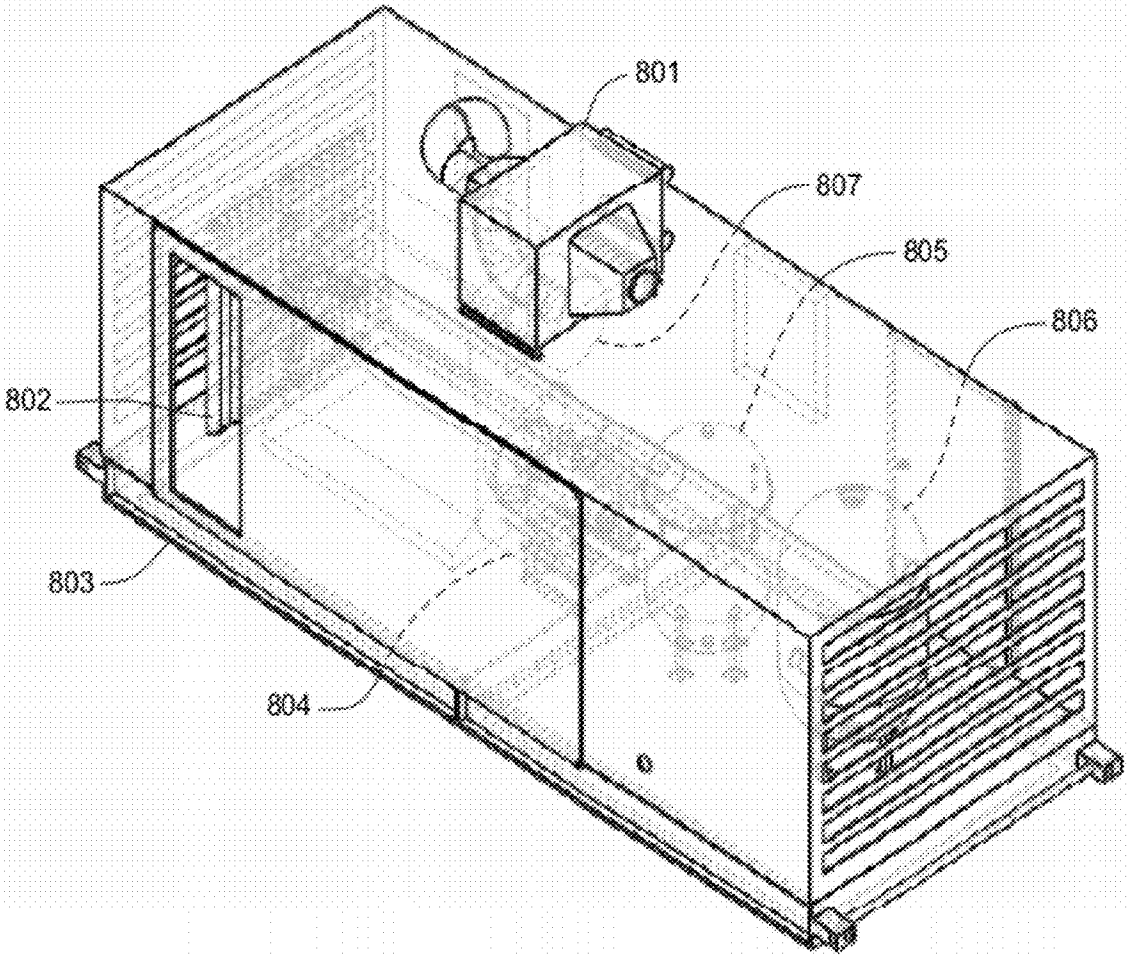
Figure 12:
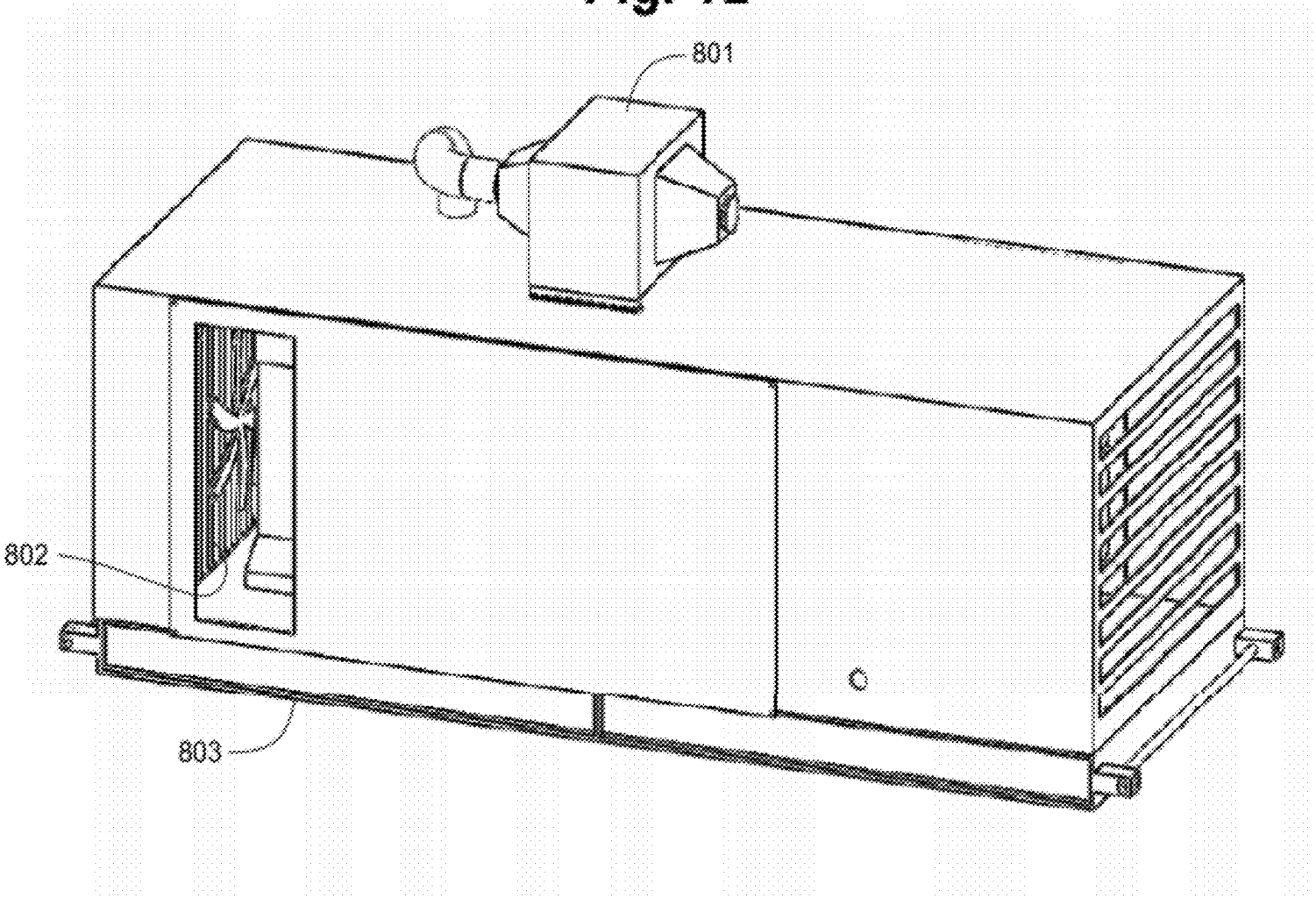
Figure 13:
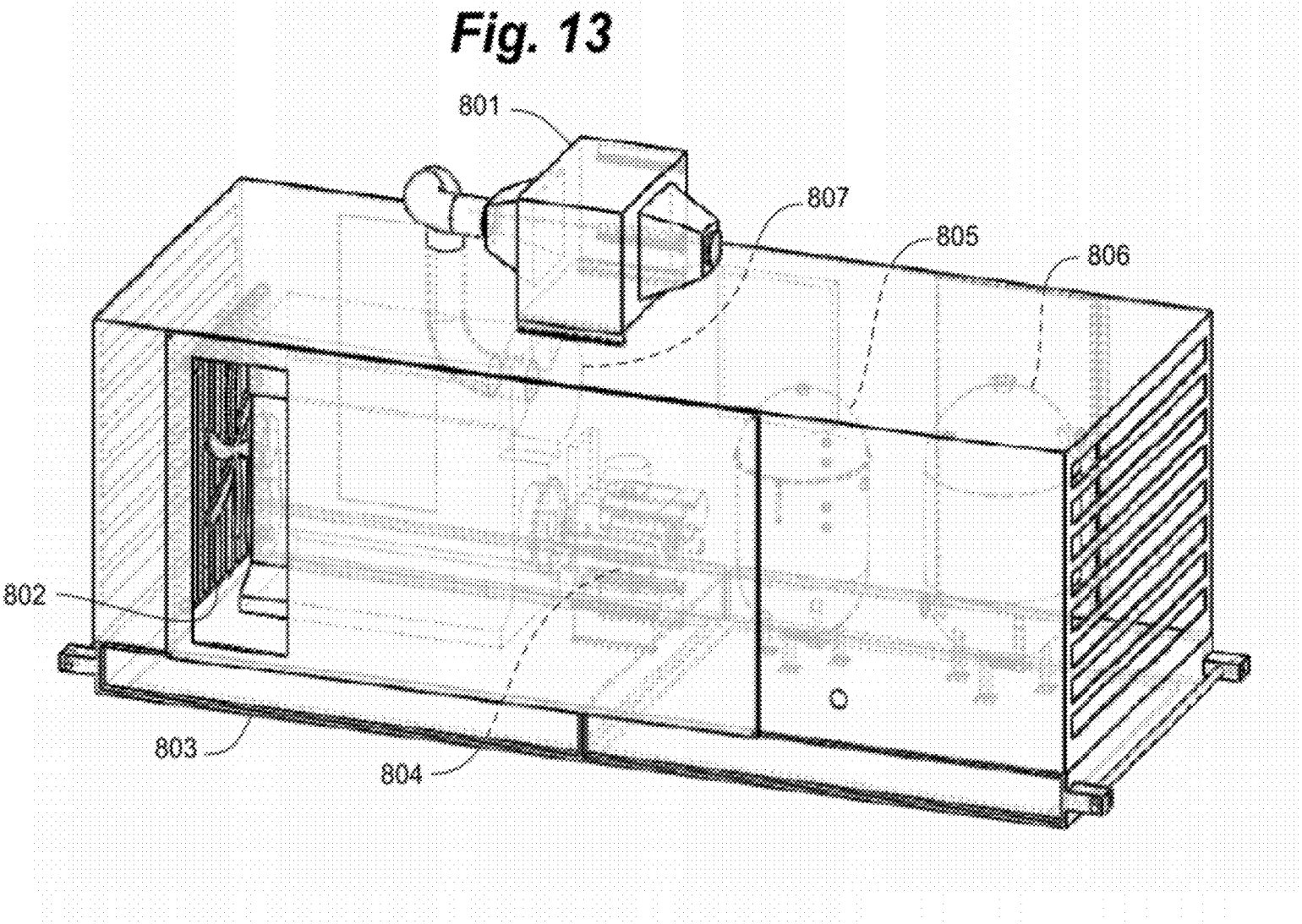
Figure 14:
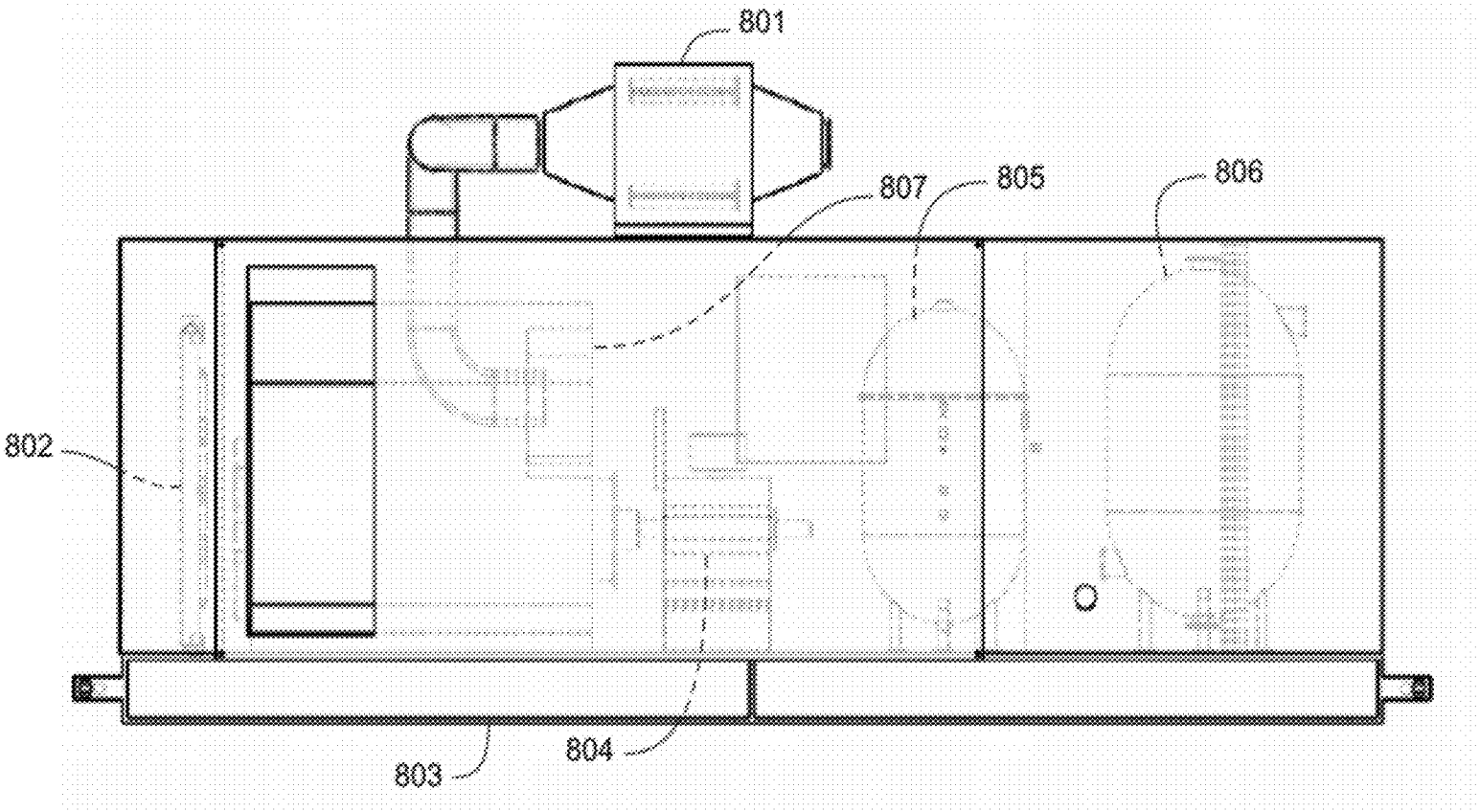
Figure 15:
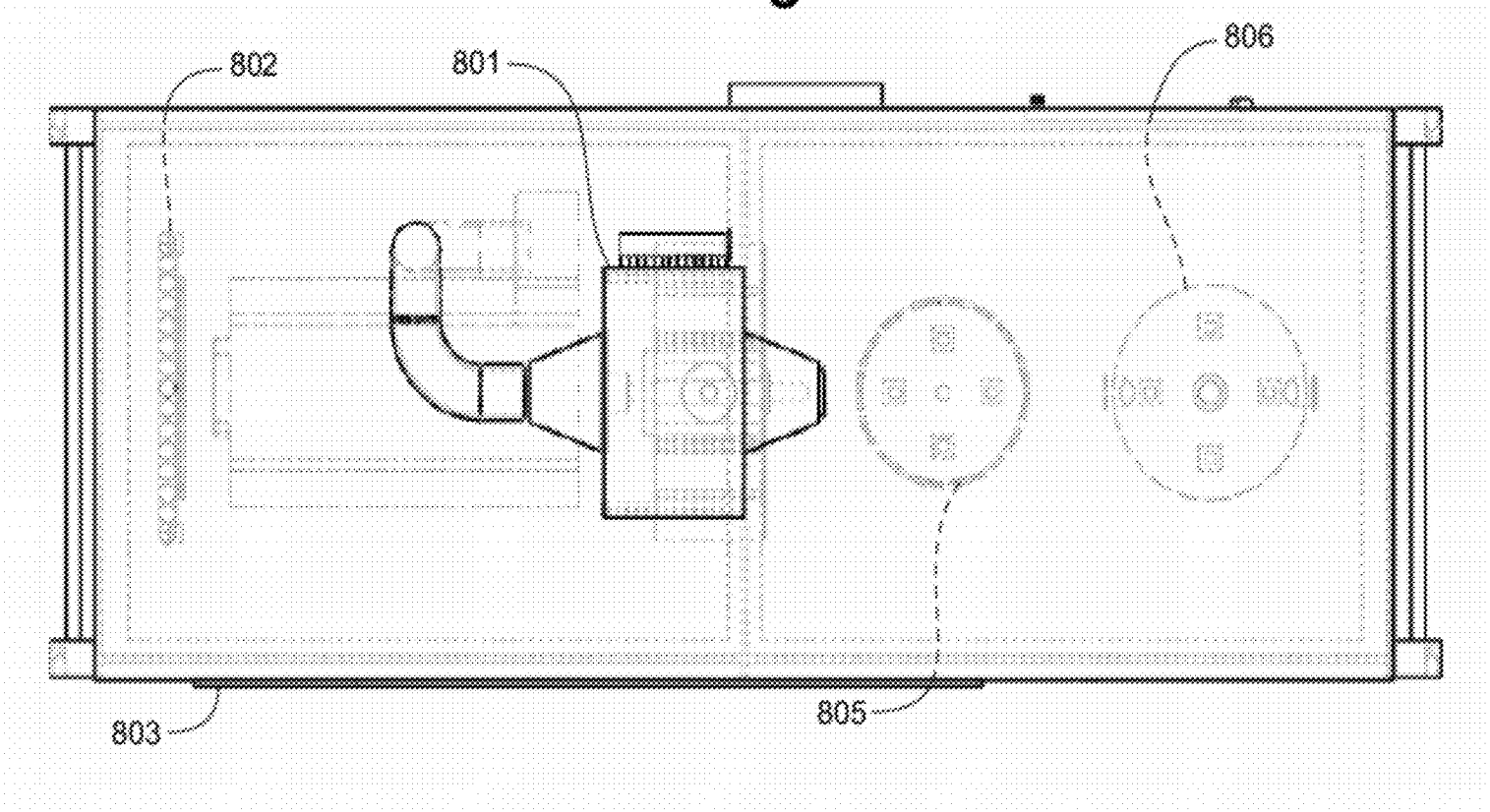
Figure 16:
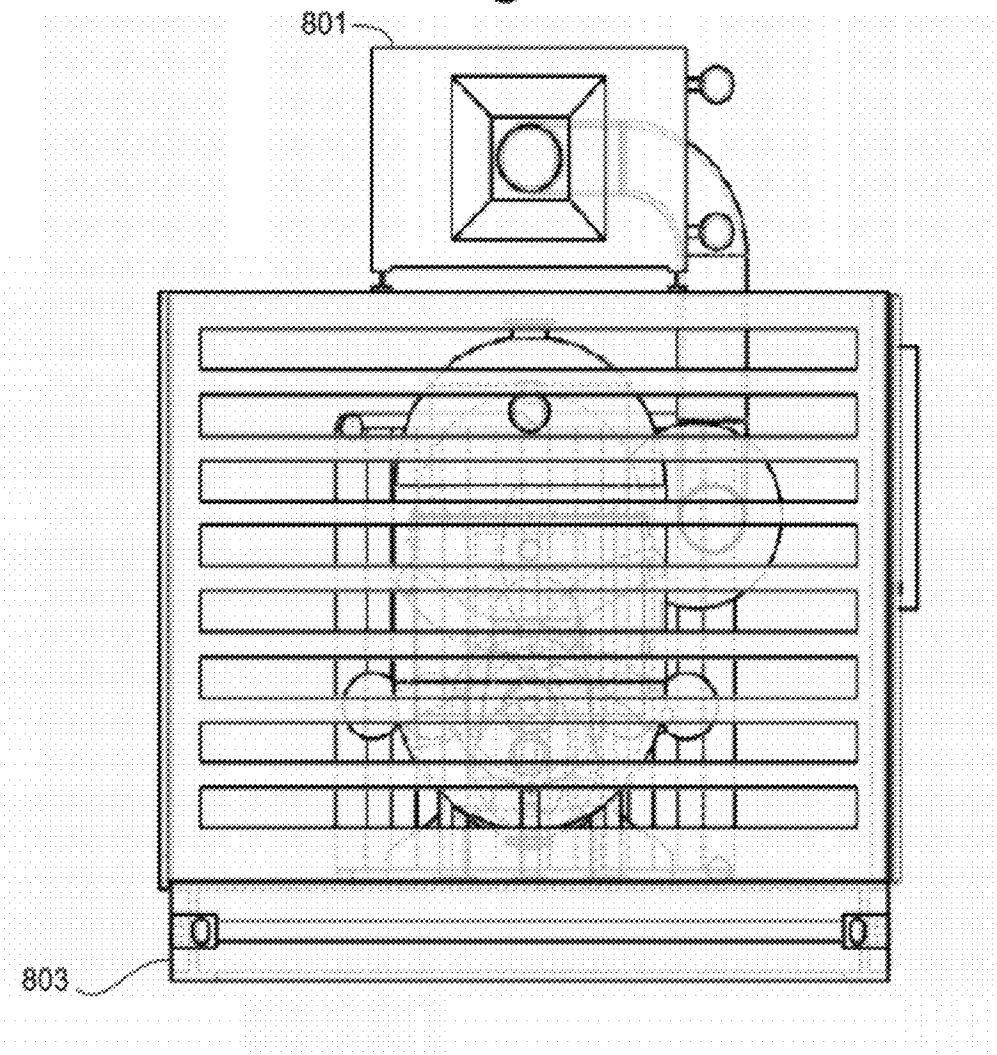

FIG. 6 shows a flowchart 600 of a process for preventing a freezing of substance lines during a pressure drop across an expansion valve and subsequent cooling according to another embodiment of the present invention. The process begins in step 602. In step 604, fluid flows through an expansion valve. In step 606, a measurement is taken of a temperature signal downstream of the expansion valve. In step 608, a control valve is actuated to regulate a flow of a substance through a heat exchanger using the temperature signal. Based on a decision made in step 610 as to the temperature value of the temperature signal, the process moves to either step 612 or step 614. In step 612, if the temperature is too high, the control valve is opened wider so that the substance spends less time in the heat exchanger, reducing its temperature. In step 614, if the temperature is too low, the control valve is tightened so the substance spends more time in the heat exchanger, increasing its temperature. The process ends in step 618 with a heated, discharged substance stream. These process steps are abbreviated in FIG. 6 for convenience.

Natural Gas Discharge Method for Discharging into a High-Pressure Receiving Location FIG. 7 shows a flowchart 700 of a process for discharging natural gas into a high-pressure receiving location according to another embodiment of the present invention. The process begins at step 702. The process proceeds according to the following steps. In step 704, receive incoming high-pressure gas input (up to 6,000 psig). In step 706, regulate the pressure to a stable intermediate pressure using an expansion valve, generating a two-phase fluid mix due to expansion cooling. In step 708, carry the two-phase fluid mix (liquid and gas) via a cryogenic line to a natural gas liquids recovery process. In step 710, recover natural gas liquids from the two-phase fluid mix. In step 712, recovered natural gas liquids flow through a discharge line into storage vessel for later pickup. In step 714, after recovering the natural gas liquids, the rest remain suspended in the fluid stream and enter into a main heat exchanger. In step 716, heat the fluid stream to approx. −20° F. in the main heat exchanger. In step 718, pass the fluid stream into a filtration vessel where all liquids are vaporized and filtered for particles. In step 720, enter a pre-compression line at a temperature of approx. −20° F. In step 722, compress the gas stream using an isentropic or adiabatic compression process. In step 724, heat up the gas using the heat of compression having an exit temperature of >50° F. In step 726, utilize a combustion engine as a driver for the compressor. Finally, in step 728, utilize a series of heat exchangers to transfer the thermal energy from the combustion engine/compressor into the cool natural gas fluid. The process ends in step 730 with a heated, discharged natural gas stream.

Advantages of the Present Invention

The present invention as described herein has many advantages over other systems and methods of decompressing and discharging compressed natural gas (CNG). Some of those advantages of the present invention over prior art discharge stations and prior art gas plants are described below. However, the present invention is not to be limited to the particular advantages described here.

By utilizing a temperature-actuated control valve as described herein, which is novel and non-obvious in itself, prevents the freezing of substance lines due to J-T cooling, and allows the use of a heat source that is not itself regulated. Traditional discharge stations and gas plants do not use a temperature-actuated valve.

Traditional discharge stations and gas plants are huge installations and far from portable. The present invention is a portable apparatus that can be taken to any location that needs to discharge CNG, and does not need to rely on a large discharge station as used at gas refineries/gas plants.

Furthermore, gas plants aren't designed for interruptible and highly variable flow. This is due to arrangements to maximize capital efficiency, and not designed for trailer emptying or finite container emptying in short cycles. In contrast, the present invention is ideally suited for interruptible and variable flow.

The present invention has robustness. Avoiding a complicated microprocessor and/or computers, and instead relying on simple controls such as PIDs, the overall reliability is considerably higher in the present invention. In active movement (portability), complicated electronics are either too expensive to make reliable, or simply not available to tolerate wide ambient conditions and shock loads due to movement.

The present invention has flexibility. The present invention alleviates the need to operate within a narrow pressure band. The flowmeter-based heat addition methods used in the prior art use a calibrated orifice plate or other meter to control flow (calibration at pressure, fluid mixture/composition, and temperature), whereas the present invention guarantees gas conditions (temperature) will be reliable throughout, as temperature doesn't need to be compensated.

The present invention allows flexibility in the heat source. Different capacity heat sources can be used and the discharge station according to the present invention will self-regulate based on heat available, delivering at least partial capacity operation instead of shutting down as prior art systems would.

The present invention is significantly more cost effective. In the present invention, controlling based on temperature leads to less expensive controls (no computers or microprocessors are needed) and less expensive instruments (globe/ball valve versus a flowmeter in the prior art).

Finally, the present invention is right-sizing for cost and efficiency. Compared to other simple methods known in the prior art (such as oversizing the heat exchangers, for example), the present invention allows heat exchangers sized for the maximum load, which tend to be smaller and more efficient.

CONCLUSION

While the methods disclosed herein have been described and shown with reference to particular operations performed in a particular order, it will be understood that these operations may be combined, sub-divided, or re-ordered to form equivalent methods without departing from the teachings of the present invention. Accordingly, unless specifically indicated herein, the order and grouping of the operations is not a limitation of the present invention.

Finally, while the foregoing written description of the invention enables one of ordinary skill to make and use what is considered presently to be the best mode thereof, those of ordinary skill will understand and appreciate the existence of variations, combinations, and equivalents of the specific embodiments, methods, and examples herein. The invention should therefore not be limited by the above described embodiments, methods, and examples, but by all embodiments and methods within the scope of the invention, as defined in the appended claims.

What is claimed is:

1. A portable natural gas discharge system for decompressing and discharging incoming compressed natural gas into a receiving location while maintaining an essentially consistent outlet temperature of the natural gas irrespective of an available heat capacity, comprising:

a base skid for holding the natural gas discharge system and all system components, said base mountable to a trailer for transport to the receiving location;

an inlet port for receiving the compressed natural gas at an inlet pressure higher than a pressure of the receiving location;

an expansion valve for regulating pressure of the natural gas to a stable intermediate pressure with a pressure drop across said expansion valve cooling the natural gas;

a cryogenic line disposed after the expansion valve for carrying a two-phase fluid mix comprising natural gas liquids and natural gas;

a natural gas liquids recovery unit for recovering a portion of the natural gas liquids having a discharge line into a storage vessel adapted to store the recovered natural gas liquids for later pickup;

a heat exchanger for heating up a remaining fluid mix comprising essentially natural gas;

a temperature-measuring device disposed after the expansion valve for measuring a temperature signal of the natural gas;

a control valve, disposed after the heat exchanger, said control valve automatically actuated by the temperature signal received from said temperature-measuring device to control a flow-rate of the natural gas through the expansion valve and the heat exchanger, wherein the flow-rate is controlled automatically depending on the available heat capacity in the heat exchanger to maintain the essentially consistent outlet temperature of the natural gas at a lower discharge pressure; and a discharge port for discharging the heated, decompressed natural gas into the receiving location.

2. The system of claim 1, further comprising:

a compressor, disposed after the control valve and before the discharge port, for compressing the natural gas to at least the pressure of the receiving location before discharge via the discharge port.

3. The system of claim 1, further comprising:

a filtration vessel disposed after the heat exchanger and before the discharge port for vaporizing all remaining liquids and for filtering particulate matter resulting in a substantially pure natural gas stream.

4. The system of claim 1, further comprising:

an internal combustion engine for generating heat for the heat exchanger.

5. The system of claim 1, wherein the heat exchanger is heated by electrical power.

6. The system of claim 1, wherein the heat exchanger exchanges heat that is provided by a hot fluid.

7. The system of claim 1, wherein the heat exchanger exchanges heat that is provided by a heat pump.

8. The system of claim 1, wherein the heat exchanger exchanges heat that is provided by waste heat from an external source.

9. The system of claim 1, wherein the heat exchanger exchanges heat that is provided by waste heat from a steam condensate return.

10. The system of claim 1, wherein the base skid is mountable to a truck.

11. The system of claim 1, wherein the base skid is mountable to a boat.

12. The system of claim 1, wherein the base skid is mountable to an airplane.

* * * * *